US009927129B2

(12) United States Patent
Bhogal et al.

(10) Patent No.: US 9,927,129 B2
(45) Date of Patent: Mar. 27, 2018

(54) THERMAL MANAGEMENT SYSTEM AND METHOD FOR A CONNECTED OVEN

(71) Applicant: June Life, Inc., San Francisco, CA (US)

(72) Inventors: Nikhil Bhogal, San Francisco, CA (US); Matthew Van Horn, San Francisco, CA (US); Mathias Watson Schmidt, San Francisco, CA (US); Drew Atkinson, San Francisco, CA (US); Gabriel Risk, San Francisco, CA (US)

(73) Assignee: June Life, Inc., San Francisco, CA (US)

( * ) Notice: Subject to any disclaimer, the term of this patent is extended or adjusted under 35 U.S.C. 154(b) by 0 days.

(21) Appl. No.: 15/170,678

(22) Filed: Jun. 1, 2016

(65) Prior Publication Data

US 2016/0348918 A1 Dec. 1, 2016

Related U.S. Application Data

(60) Provisional application No. 62/169,323, filed on Jun. 1, 2015.

(51) Int. Cl.

| | |
|---|---|
| ***F24C 7/08*** | (2006.01) |
| ***F24C 15/00*** | (2006.01) |
| ***F24C 15/04*** | (2006.01) |

(52) U.S. Cl.

CPC ..... *F24C 15/006* (2013.01); *F24C 7/086* (2013.01); *F24C 15/04* (2013.01)

(58) Field of Classification Search

CPC ..... F24C 15/006; F24C 7/081; F24C 7/086

USPC ..... 126/21 R, 21 A, 198, 193

See application file for complete search history.

(56) References Cited

U.S. PATENT DOCUMENTS

| | | | | | |
|---|---|---|---|---|---|
| 2,526,890 | A | * | 10/1950 | Mendel | F24C 3/027 126/190 |
| 3,453,997 | A | * | 7/1969 | Klepzig | F24C 15/02 126/198 |
| 3,889,099 | A | * | 6/1975 | Nuss | F24C 15/006 126/198 |
| 3,911,893 | A | * | 10/1975 | Baker | F24C 15/006 126/198 |
| 4,241,718 | A | * | 12/1980 | Barnett | F24C 15/006 126/19 R |
| 4,255,640 | A | * | 3/1981 | Bressler | H05B 6/6414 126/190 |

(Continued)

FOREIGN PATENT DOCUMENTS

| | | |
|---|---|---|
| CN | 202392848 U | 8/2012 |
| CN | 203914599 U | 11/2014 |

(Continued)

*Primary Examiner* — David Angwin
*Assistant Examiner* — John J Norton
(74) *Attorney, Agent, or Firm* — Jeffrey Schox; Diana Lin

(57) ABSTRACT

The connected oven includes a cooking cavity defined by a back, a door opposing the bottom, a top adjacent the back and door, a bottom opposing the top, and opposing sidewalls adjacent the remainder of the walls, a user interface unit configured to receive instructions from the user, a sensor, and a thermal management system for minimizing or preventing thermal damage to heat-sensitive components arranged on the oven.

24 Claims, 13 Drawing Sheets

(56) References Cited

U.S. PATENT DOCUMENTS

| | | | | |
|---|---|---|---|---|
| 2006/0219234 | A1* | 10/2006 | Larsen | F24C 15/04 126/198 |
| 2008/0184985 | A1* | 8/2008 | Hasslberger | F24C 15/006 126/21 R |
| 2009/0032010 | A1* | 2/2009 | Hoffmeier | F24C 7/082 126/198 |
| 2010/0145483 | A1 | 6/2010 | McGonagle et al. | |
| 2011/0261518 | A1* | 10/2011 | Krische | D06F 39/005 361/679.01 |
| 2013/0171304 | A1 | 7/2013 | Huntley | |
| 2014/0048055 | A1* | 2/2014 | Ruther | A21B 3/02 126/198 |
| 2015/0015519 | A1* | 1/2015 | Scotto D'Apollonia | A47L 15/4293 345/173 |
| 2015/0056344 | A1 | 2/2015 | Luckhardt | |
| 2015/0260413 | A1* | 9/2015 | Chadwick | F24C 15/02 126/21 R |
| 2015/0285513 | A1 | 10/2015 | Matarazzi et al. | |

FOREIGN PATENT DOCUMENTS

| | | | | |
|---|---|---|---|---|
| DE | 102008043722 | A1 | 5/2010 | |
| DE | 102012204229 | A1 | 9/2013 | |
| EP | 0298858 | B1 | 11/1990 | |
| EP | 0899512 | A1 | 3/1999 | |
| FR | 2746903 | A1 * | 10/1997 | F24C 15/006 |
| GB | 1195750 | A * | 6/1970 | F24C 15/04 |
| WO | WO 2009012874 | A2 * | 1/2009 | F24C 7/082 |
| WO | 2014086487 | A1 | 6/2014 | |

* cited by examiner

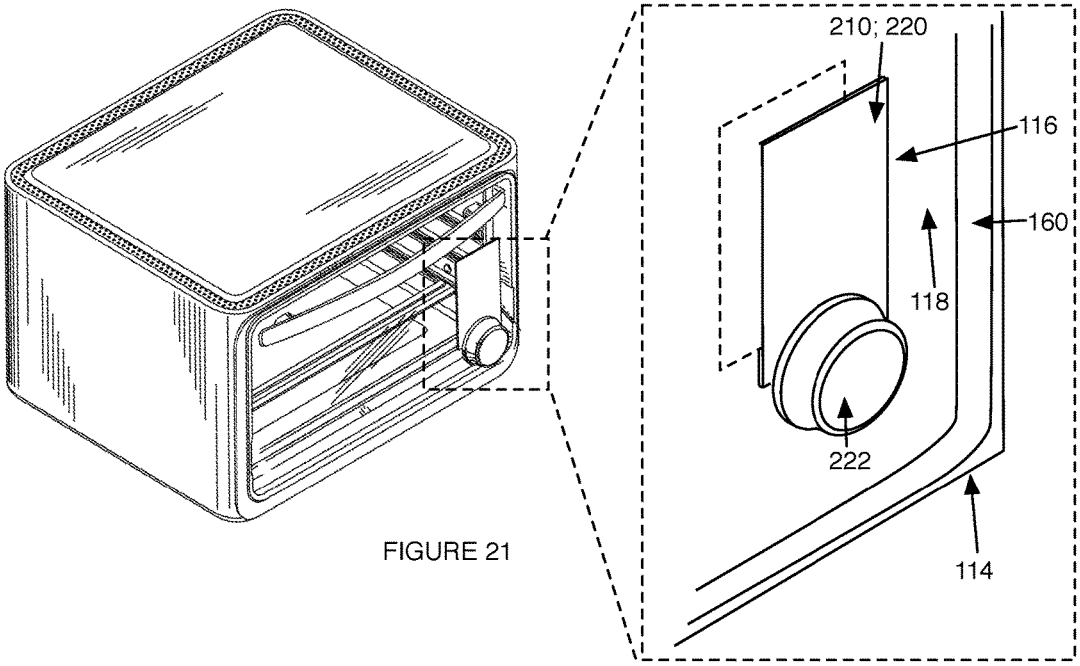
FIGURE 21
FIGURE 22
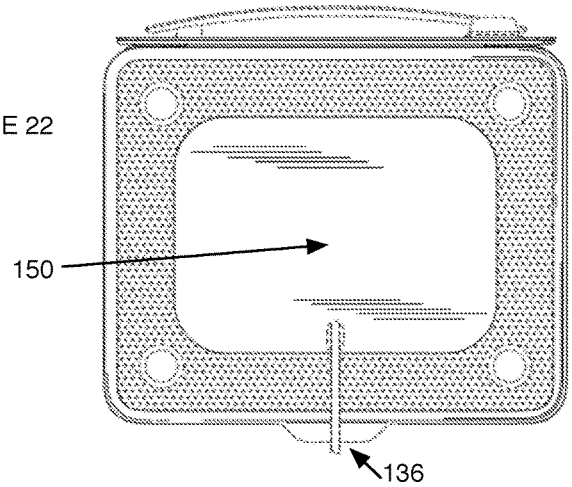

THERMAL MANAGEMENT SYSTEM AND METHOD FOR A CONNECTED OVEN

CROSS-REFERENCE TO RELATED APPLICATIONS

This application claims the benefit of U.S. Provisional Application No. 62/169,323 filed 1 Jun. 2015, which is incorporated in its entirety by this reference. This application is related to U.S. application Ser. No. 15/147,597 filed 5 May 2016, which is incorporated in its entirety by this reference.

TECHNICAL FIELD

This invention relates generally to the cooking apparatus field, and more specifically to a new and useful thermal management system and method in the cooking apparatus field.

BRIEF DESCRIPTION OF THE FIGURES

FIG. 21 is a perspective view of a variation of a user interface unit of the oven.

FIG. 22 is a perspective view of a variation of the oven with a wall offset.

DESCRIPTION OF THE PREFERRED EMBODIMENTS

The following description of the preferred embodiments of the invention is not intended to limit the invention to these preferred embodiments, but rather to enable any person skilled in the art to make and use this invention.

1. Overview—Connected Oven

Figure 1:
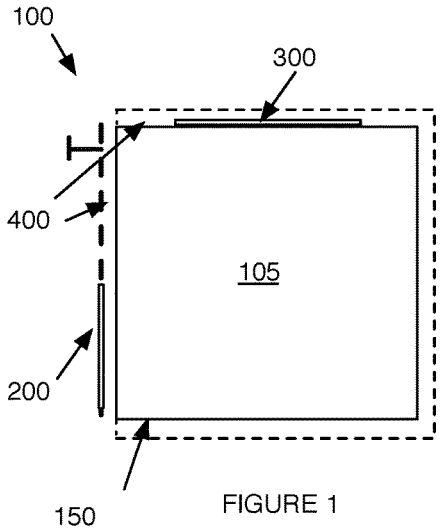
FIG. 1 is a schematic representation of the fluid paths within the oven.

As shown in FIG. 1, the connected oven 100 can include a set of panels cooperatively defining a cooking cavity 105, a user interface unit 200 configured to receive instructions from the user, a control system 300, and a thermal management system 400 for minimizing or preventing thermal damage to heat-sensitive components arranged on the oven.

The inventors have discovered that an oven with a smaller footprint and/or increased control opportunities can be achieved by replacing a conventional control panel for an oven with a touchscreen, such as the system disclosed in U.S. application Ser. No. 15/147,597 filed 5 May 2016 titled "Connected Food Preparation System and Method of Use," incorporated herein in its entirety by this reference. However, this replacement has created new problems. In particular, the touchscreen components are heat-sensitive, and the inventors have effectively replaced a heat-tolerant component (conventional control panels) with a heat-sensitive component (the touchscreen). Furthermore, in some variants, the inventors have further reduced the oven footprint by arranging the touchscreen along an oven panel defining the cooking cavity 105, instead of arranging the touchscreen adjacent (e.g., offset) from the cooking cavity 105. This arrangement directly exposes the touchscreen to thermal radiation from the cooking cavity 105. Thus, there is a need in the oven field to create a new and useful thermal management system 400 to accommodate the issues created by incorporating a touchscreen into an oven.

The inventors have further discovered that new control opportunities can be achieved by incorporating control systems 300 into the oven. In particular, the control systems 300 can include wireless communication systems, data processing systems 320, or other high-computational powered components. While these components can confer increased processing power and functionality, these components are heat sensitive and generate a substantial amount of heat during operation, making these components non-ideal for inclusion within a high-heat application, such as an oven. Furthermore, the control system 300 can be arranged along an oven panel defining the cooking cavity 105 in some variations to reduce the oven footprint, effectively exposing the control system 300 components to radiant heat or placing the control system 300 components within the cooking cavity heat removal pathway. Thus, there is a further need in the oven field to create a new and useful thermal management system 400 to accommodate the issues created by incorporating control system 300*s* into an oven.

Figure 2:
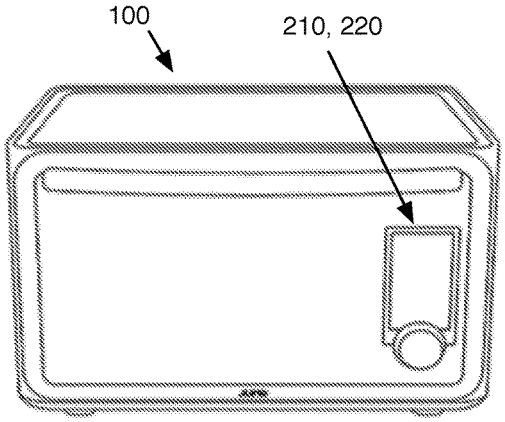
FIG. 2 is a perspective view of a variation of the oven.

In a first variation as shown in FIG. 2, the touchscreen is overlaid over a portion of the oven door 110. More specifically, the oven door 110 is a dual-panel door, including an exterior and interior panel cooperatively defining an air gap therebetween, wherein the touchscreen is mounted to the exterior panel. The interior and exterior panels can be substantially permanently coupled, or be removably coupled. The air gap can be open to the ambient environment along a first and second end, such that ambient air can flow from the first end, through the air gap, to the second end. This air gap can function to thermally insulate the touchscreen from the cooking cavity 105, and can additionally function to cool the touchscreen.

In a second variation, the control system 300 is mounted to a portion of the oven top 120 and enclosed by a secondary top panel 124. The secondary top panel 124 and primary top panel 122 (the panel directly defining the cooking cavity 105) can cooperatively define a top fluid channel 430 therebetween, wherein the control system 300 is arranged within the top fluid channel 430. The control system 300 can be directly mounted to the primary top panel 122 broad face, mounted to a set of cooling features 490 extending from the primary top panel 122 broad face (e.g., such that a first and second fluid channel is defined above and below the control system 300), mounted to the secondary top panel 124, or mounted to any other suitable component. The top fluid channel 430 can be open to the ambient environment at a first and/or second end, fluidly connected to a secondary fluid channel at a first and/or second end, or be connected to any other suitable fluid source. The top fluid channel 430 can function to thermally insulate the control system 300 from the cooking cavity 105 and/or function to cool the control system 300. However, the thermal management system 400 can be incorporated in any other suitable configuration into any other suitable oven variant.

1.1 Potential Benefits

The connected oven can confer several benefits over conventional ovens. First, the connected oven can include a thermal management system for thermally protecting heat-sensitive components (e.g., a user interface unit, a camera, a wireless communication system, etc.) that can facilitate real-time foodstuff identification (e.g., foodstuff analysis for determining the type of foodstuff in the cooking cavity), automatic determination of user preferences (e.g., determining oven operation parameters or patterns that lead to a given cooking outcome), remote monitoring (e.g., a user using a mobile smartphone to monitor the progress of the cooking process at the cooking cavity), dynamic thermal adjustment monitoring (e.g., adjusting cooking cavity temperature based on identification of the cooking stage of the foodstuff), and/or perform any other suitable activity. For example, a camera assembly for real-time food stuff identification can be arranged within an oven top fluid cooling channel that enables ambient air to cool the camera assembly. Through thermal protection of heat-sensitive components, the connected oven 100 can, for example, extend the lifespan of connected ovens, reduce repair costs, and maintain heat-sensitive component functionality.

Second, the connected oven can facilitate an aesthetically pleasing user experience while satisfying thermal management requirements of heat-sensitive components. For example, some oven variations can include an edge to edge glass door that can enable a larger, clearer cavity viewing area while thermally insulating user interface components from the cooking cavity and a thermally conductive metal door bezel. The connected oven can additionally utilize fluid cooling channels defined by dual-panel oven walls while maintaining an aesthetically favorable physical footprint. External fluid connections (e.g., perforations, air gaps, etc.) for connecting the environment to fluid cooling channels can be defined at exterior oven panels, thereby adding unique contour and shape to the oven body.

Third, the connected oven can leverage the thermal management system to improve aspects of a user's experience with different components of the connected oven. For example, sidewalls 140 constructed with molded insulation (e.g., molded fiberglass) can enable cool-touch exterior sidewalls 140 for both safety and user-experience. In another example, a dual-panel, glass oven door can thermally insulate a touch screen user interface and display from heating elements 500 at the cooking cavity. Similarly, the dual-panel glass oven door, can thermally insulate a thermally conductive user interface (e.g., metal knob) from the cooking cavity.

Fourth, the connected oven can confer increased control over thermal distribution and/or thermal gradients within the cavity. In particular, the connected oven can be dynamically controlled by a processing system (on-board or remote). The processing system can dynamically adjust individual convection elements, heating elements 500, or other oven components to accommodate safety parameters for heat-sensitive components, cooking parameter deviations from a target value, create desired thermal profiles within the cavity interior, or otherwise selectively control oven operation.

1.2 Cooking Cavity

As shown in FIG. 1, the cooking cavity 105 of the connected oven 100 functions to receive and apply heat to foodstuffs. The cooking cavity 105 is preferably cooperatively defined by a set of oven walls, but can alternatively be otherwise defined. The oven walls can additionally or alternatively include a back, a door opposing the bottom, a top adjacent the back and door, a bottom opposing the top, and/or opposing sidewalls 140 adjacent the remainder of the walls. A given oven wall can be single panel, multi-panel (e.g., dual panel), vacuum-insulated panels, or be any other suitable panel. When the oven walls include a primary panel (e.g., an interior panel; an inner panel) and secondary panel (e.g., an exterior panel; an outer panel), the panels can be substantially permanently together or removably coupled (e.g., by grooves, clips, magnetic elements, etc.). The primary panel can be the panel directly defining the cooking cavity, while the secondary panel can be the panel defining the oven exterior. However, the primary and secondary panels can be otherwise arranged or configured. The oven walls can be transparent, opaque, or have any other suitable translucency. The oven walls can be made from a thermally conductive material, thermally insulative material, or from any other suitable material. The oven panels can be made of glass, metal, ceramic, plastic (e.g., thermoset), or any other suitable material or combination thereof.

The back, top, and sidewall oven walls 140 are preferably joined together (e.g., formed as a singular piece, joined together, stamped, etc.). The door can actuate relative to the remainder of the oven panels to transiently seal and unseal the cooking cavity lumen. For example, the oven door 110 can be actuatable between an open position and a closed position relative the oven body. The door can actuate (e.g., rotate, slide, etc.) along a vector perpendicular the door longitudinal axis, along a vector perpendicular the door lateral axis, or actuate along any other suitable axis. For example, the door can be hinged along an oven side, hinged along the oven bottom, or be otherwise coupled to the oven body. The oven panels are preferably substantially solid (e.g., fluid impermeable), but can alternatively or additionally include external fluid connections 470. In one example, the oven panels can include perforations along the panel perimeter or body, or air gaps cooperatively defined between the panel and an adjacent panel, that function to fluidly connect the cooking cavity interior with the panel exterior. However, the oven panels can include any other suitable external fluid connection 470. As shown in FIG. 22, in another example, the oven back 130 (e.g., an external back panel of the oven back 130) can include one or more wall offsets 136 extending away from the cooking cavity 105. Alternatively, any suitable oven panel can include a wall offset 136 in order to separate the connected oven 100 from walls of a living space. However, the oven panels can include any other suitable feature.

The cooking cavity 105 and the oven walls can additionally or alternatively be configured in any manner analogous to those disclosed in related U.S. application Ser. No. 15/147,597 filed 5 May 2016 and titled, "CONNECTED FOOD PREPARATION SYSTEM AND METHOD OF USE," which is hereby incorporated in its entirety by this reference.

1.3 Heat-Sensitive Components

The heat-sensitive components of the system function to interact with a user, user device, and/or remote system. Heat-sensitive components can include a user interface unit 200 and a control system 300, but the oven can include any other suitable heat-sensitive component.

Heat-sensitive components can be welded, screwed, glued, mechanically affixed, and/or mounted through any suitable coupling means to components (e.g., oven panels) of the connected oven 100.

Heat-sensitive components can additionally or alternatively be configured in any manner analogous to those disclosed in related U.S. application Ser. No. 15/147,597.

1.3.1 User Interface Unit

As shown in FIGS. 2 and 21, the user interface unit 200 functions to receive input from a user. The user interface unit 200 can additionally function to present information to a user. The user interface unit 200 can include a display 210 and a user input device 220. The user interface unit 200 can additionally include a second user input device 220', the processing system 320, computer memory, the communication system 600, or any other suitable component.

The user interface unit 200 is preferably mounted to a user interface mounting region 116 defined by the oven door 110 (e.g., an exterior panel of the oven door 110. Additionally or alternatively, the user interface unit 200 can be mounted to any suitable oven panel, but different components of the user interface unit 200 can be mounted to different suitable portions of the connected oven 100. The user interface unit 200 is preferably arranged with a normal vector intersecting the cooking cavity 105 when the oven door 110 is in the closed position, but can alternatively be arranged with the normal vector offset from the cooking cavity, or arranged in any suitable configuration. When the oven door 110 is in a fully open position, the user interface unit 200 can be arranged with a normal vector parallel the normal vector of the oven bottom 150, perpendicular the normal vector of the oven bottom, or otherwise arranged. However, the user interface unit 200 can be arranged in any suitable manner.

In a first variation, the components of the user interface unit 200 are each mounted to the same oven panel. For example, a display 210, input device 220, and processors 320 of a user interface unit 200 can each be mounted to an exterior door panel 114 of the oven door 110. Additionally or alternatively, each of the components of the user interface unit 200 in the first variation can be thermally connected to one or more components of the connected oven 100 (e.g., a fluid channel 410 defined by a dual-panel oven door 110). However, with respect to mounting positions on the same oven panel, different components of the user interface unit 200 can be adjacent, overlaid, and/or separated.

In a second variation, different components of the user interface unit 200 can be mounted or physically connected to different oven panels. For example, a first input device 220 and display 210 can be mounted to the oven door 110, and a second input device 220' can be mounted to an oven side wall 140. In another example, an input device 220 can be mounted to an exterior door panel 114, and a display 210 can be mounted to an interior door panel 112. However, any suitable user interface unit 200 component can be mounted to any suitable oven component.

The user interface unit 200 and/or components of the user interface unit 200 (e.g., display 210, input device 220, etc.), can additionally or alternatively be configured in any manner analogous to those disclosed in related U.S. application Ser. No. 15/147,597 filed 5 May 2016 and titled, "CONNECTED FOOD PREPARATION SYSTEM AND METHOD OF USE."

1.3.1.a Display

The user interface unit 200 can optionally include a display 210, which functions to display oven parameters, settings, notifications, recipes, or other oven-related information. The display 210 is preferably heat-sensitive (e.g., degrades at temperatures above 100° C., above 50° C., above 200° C., etc.), but can alternatively be substantially heat-tolerant (e.g., be stable at the aforementioned temperatures). Examples of the display 210 include an LED display, OLED display, plasma display, projection display, or any other suitable display 210. The display 210 can be transparent, opaque, or have any other suitable translucency.

The display 210 is preferably arranged along an exterior surface of an oven component (e.g., opposing the cooking cavity 105 across a component thickness), but can alternatively or additionally be arranged along an exterior surface of an oven panel (e.g., a panel directly defining the cooking cavity 105), be arranged along the interior surface of the oven component, be arranged adjacent or offset the cooking cavity 105, or be arranged in any other suitable location. The display 210 can extend across a portion or across the entirety of the component broad face. Alternatively, the display 210 can replace a portion of the component. Examples of components that can support the display 210 include the oven door 110, sidewall 140, back 150, top 120, bottom 150, along the wall parallel to and adjacent the oven door 110 (e.g., wherein the oven door 110 is shorter than the back wall 130), or along any other suitable oven surface.

In a specific variation, the display 210 is arranged along the oven door 110, wherein the display 210 opposes the cooking cavity 105 (e.g., wherein a normal vector from the display 210 active face intersects the cooking cavity volume). The display 210 is preferably arranged along a secondary door panel 114 arranged a predetermined distance external the primary door panel 112, wherein the primary door panel 112 directly defines the cooking cavity 105. The display 210 is preferably arranged along the interior of the secondary door panel 114, but can alternatively be arranged along an exterior of the secondary door panel 114 (e.g., an exterior door panel 114) or replace a portion of the secondary door panel 114. The display 210 is preferably contiguous with a bezel 160 or edge of the display 210 (e.g., such that any wires connecting the display 210 to the control system 300 can be hidden by the bezel 160), but can alternatively be offset from the bezel 160, centered along the door or be otherwise arranged.

1.3.1.b Input Device

The user interface unit 200 can optionally include an input device 220, which functions to receive user inputs for oven control. The input device 220 can be heat-sensitive (e.g., degrades at temperatures above 100° C., above 50° C., above 200° C., etc.), or can be substantially heat-tolerant (e.g., be stable at the aforementioned temperatures). Examples of the input device 220 include a touch sensor or touch screen, knob 222 (e.g., metal or plastic knob), buttons, or any other suitable input device 220. Examples of touch-screens include resistive touch screens, surface acoustic wave touch screens, infrared grid touch screens, optical image touch screens, dispersive signal touch screens, acoustic pulse touch screens, capacitive touch screens (surface capacitance, projected capacitance, mutual capacitance), ITO touch screens, or any other suitable touch screens. The input device 220 can be transparent, opaque, or have any other suitable translucency. The input device 220 can be electrically connected to the display 210, electrically connected to the control system 300, and/or electrically connected to any other suitable component. The knob 222, buttons, or other user input are preferably made of thermally-conductive material (e.g., metal, such as stainless steel), but can alternatively be plastic, ceramic, or made of any other suitable material. In one example, the user interface unit 200 can include a rotary knob 222, the rotary knob 222 actuatable about a rotary axis and arranged with the rotary axis intersecting the cooking cavity 105. The user inputs are preferably constantly defined, but can alternatively be dynamic (e.g., buttons dynamically created by fluid channels 410). However, any other suitable input device 220 can be used.

The input device 220 is preferably arranged along an exterior surface of an oven component (e.g., opposing the cooking cavity 105 across a component thickness, such that a normal vector from the input device broad face intersects the cooking cavity volume), but can alternatively or additionally be arranged along an exterior surface of an oven panel (e.g., a panel directly defining the cooking cavity 105), be arranged along the interior surface of the oven component, be arranged adjacent or offset the cooking cavity 105, or be arranged in any other suitable location. The input device 220 can extend across a portion or across the entirety of the component broad face. Alternatively, the input device 220 can replace a portion of the component. Examples of components that can support the input device 220 include the oven door 110, sidewall 140, back 150, top 120, bottom 150, along the wall parallel to and adjacent the oven door 110 (e.g., wherein the oven door 110 is shorter than the back wall), or along any other suitable oven surface. In one variation, the input device 220 is arranged over all or a portion of the display 210, wherein the input device 220 can be directly mounted to the display 210 (e.g., the active face of the display 210), mounted to the oven wall opposing the display 210 across the wall thickness, or be otherwise mounted relative to the display 210. In one example of this variation, the user interface unit 200 can include a touch screen input device 220 overlaying a display 210 mounted to the oven door 110 (e.g., an exterior panel of the oven door no). Alternatively, the input device 220 can be separate and distinct from the display 210. However, the input device 220 can be otherwise arranged.

1.3.2 Control System

The control system 300 of the connected oven 100 functions to control oven operations, oven communications, the display 210, and/or receive control instructions from the input device 220. The control system 300 can include a processor 320 (e.g., a CPU, GPU, microcontroller, etc.), sensors 310 (e.g., cameras, temperature sensors, etc.), emitters, communication systems (e.g., a wireless communication system), and/or any other suitable component. The control system 300 can include a communication module that functions to communicate with a remote system (e.g., WiFi, Zigbee, Z-wave, etc.); a processing system 320 that functions to control oven operations based on oven sensor 310 readouts, instructions received from the remote system, and/or user inputs from the input device 220; memory (e.g., volatile or non-volatile); and/or any other suitable component. The board can additionally function to mount the control system 300 to the oven wall, and can function as the intermediary panel in some oven variants. In one example, the connected oven 100 can include a processing system 320 connected to a user interface unit 200 and a camera assembly sensor 310, where the processing system 320 can be mounted to the user interface unit 200, and the processing system 320 can be thermally connected to a door fluid channel 420 defined by interior and exterior door panels 114 of a dual-panel oven door 110.

The oven can include one or more control systems. In one variation, the oven includes a single control system 300 electrically connected to and configured to control the input device 220, the display 210, and the oven components. In a second variation, the oven can include a first and a second control system 300, wherein the first control system 300 can be configured to control display 210 and/or input device 220 operation, and the second control system 300 can be configured to control oven operation based on instructions received (through a wired or wireless connection) from the first control system 300 and/or communicate with a remote system. In this variation, the first control system 300 can be arranged adjacent the display 210 and/or input device 220 (e.g., behind the display 210, within the input device 220, etc.), while the second control system 300 can be arranged along a portion of the oven with little to no EMF interference (e.g., along the top of the oven). However, the oven can include any suitable number of control systems 300, configured in any suitable hierarchy and arranged in any other suitable location.

The control system 300 is preferably enclosed within the oven, but can alternatively be open to ambient or otherwise arranged. The control system 300 can be physically connected to the cooking cavity 105 (e.g., fluidly connected through an aperture in the cavity wall), fluidly isolated and thermally connected to the cooking cavity 105, fluidly and thermally isolated from the cooking cavity 105, or otherwise arranged. The control system 300 can additionally include a board or substrate that functions to physically and/or electrically connect the control system components. The control system 300 is preferably arranged along an exterior surface of an oven component (e.g., opposing the cooking cavity 105 across a component thickness, such that a normal vector from the control system board intersects the cooking cavity volume), but can alternatively or additionally be arranged along an exterior surface of an oven panel (e.g., a panel directly defining the cooking cavity 105), be arranged along the interior surface of the oven component, be arranged adjacent or offset the cooking cavity 105, or be arranged in any other suitable location. The control system 300 can extend across a portion or across the entirety of the component broad face. Alternatively, the control system 300 can replace a portion of the component. Examples of components that can support the control system 300 include the oven door 110, sidewall 140, back 150, top 120, bottom 150, along the wall parallel to and adjacent the oven door 110 (e.g., wherein the oven door 110 is shorter than the back wall), or along any other suitable oven surface. In one variation, the control system 300 can be arranged along the waste heat path of the cooking cavity 105 (e.g., along the top of the cooking cavity 105, along a portion of the oven having low or minimal EMF interference). In this variation, the oven top 120 can include dual panels that cooperatively define a cooling channel encapsulating the control system 300, wherein the cooling channel can direct fluid to flow perpendicular to the rising heat from the cooking cavity 105. In a second variation, the control system 300 can be arranged along the top of the oven and thermally insulated from the cooking cavity 105 by thermally insulative material, such as foam or ceramic. In a third variation, the control system 300 can be arranged behind the display 210. In a fourth variation, the control system 300 can be arranged offset the cooking cavity 105. However, the control system 300 can be otherwise arranged.

The control system 300 and/or components of the control system 300 (e.g., sensor 310, processing system 320, emitter, etc.) can additionally or alternatively be configured in any manner analogous to those disclosed in related U.S. application Ser. No. 15/147,597 filed 5 May 2016 and titled, "CONNECTED FOOD PREPARATION SYSTEM AND METHOD OF USE."

1.3.2.a Sensor

Figure 19:
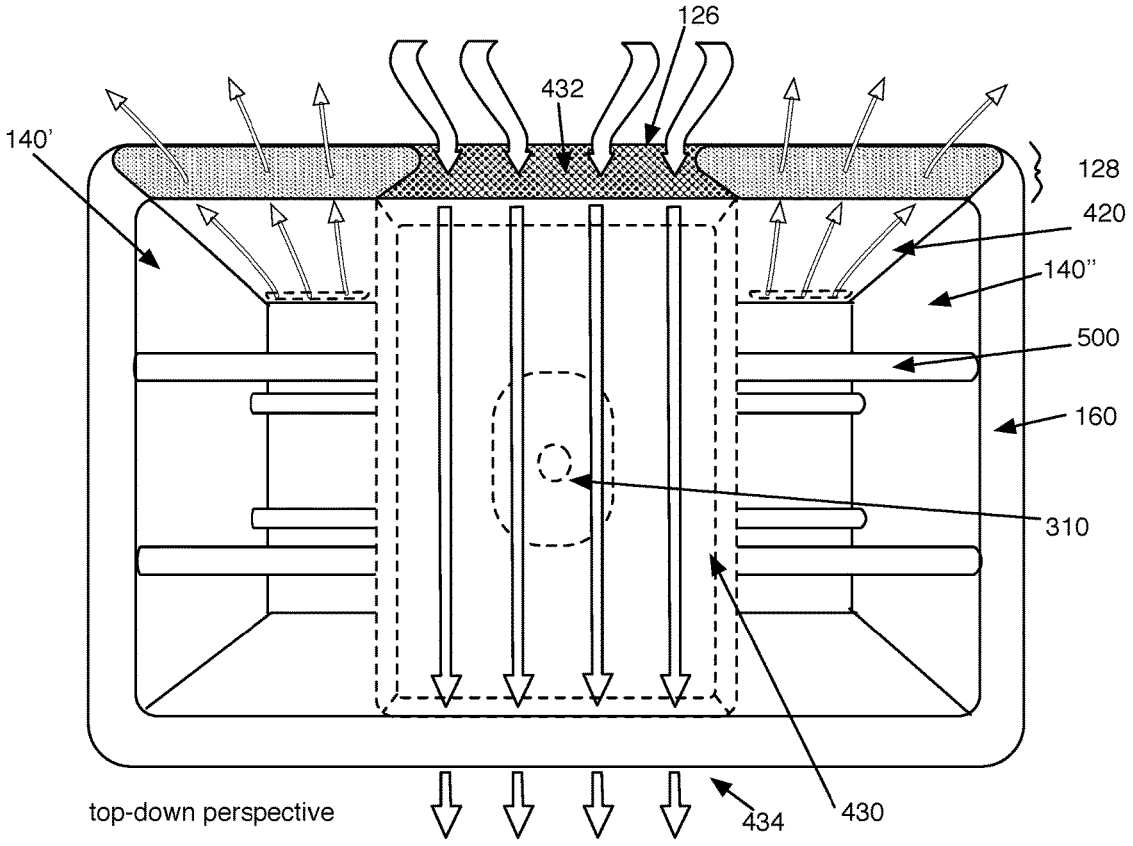
FIG. 19 is a top-down perspective view of a variation of the oven.
Figure 20:
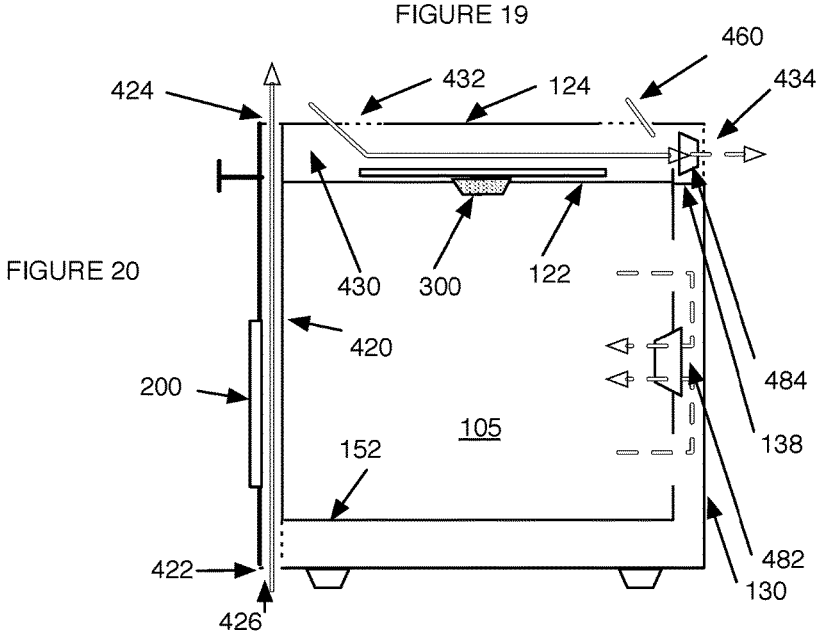
FIG. 20 is a schematic representation of a fluid flow pattern through the oven.
Figure 23:
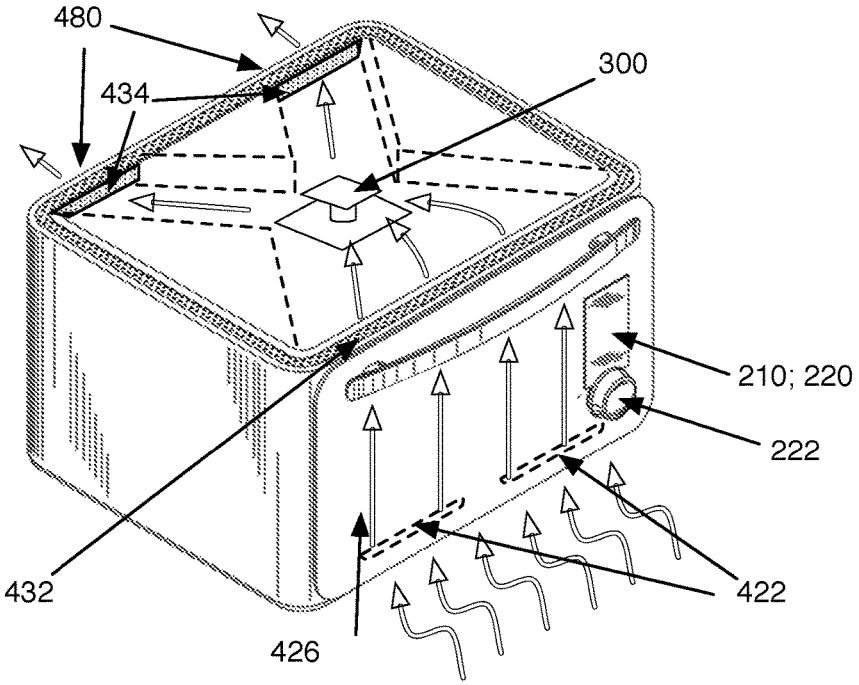
FIG. 23 is a schematic representation of a specific example of the oven including a cooling path thermally insulating the display and control system from the cooking cavity and cooling heat-generating components.
Figure 24:
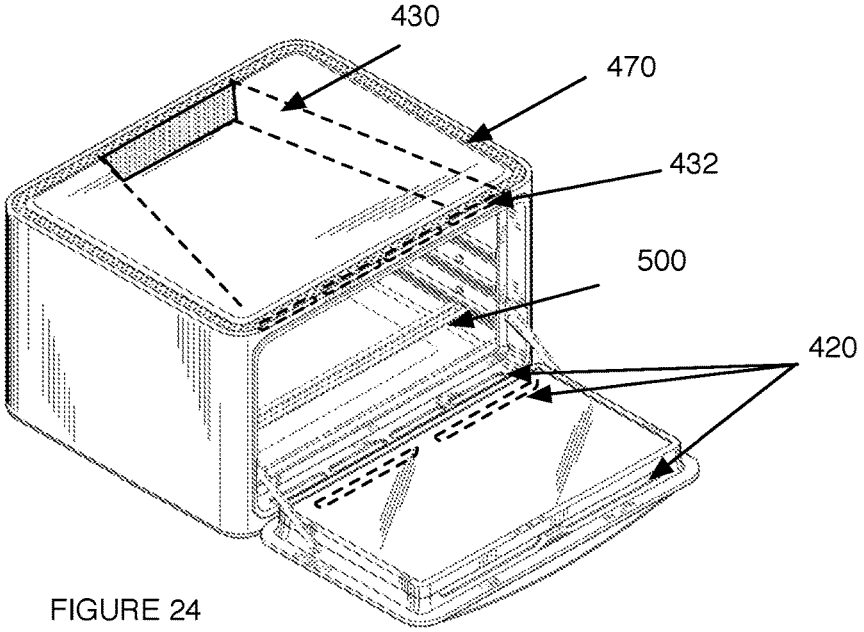
FIGS. 24 to 27 are schematic representations of a first, second, third, and fourth top cooling channel configuration.
Figure 25:
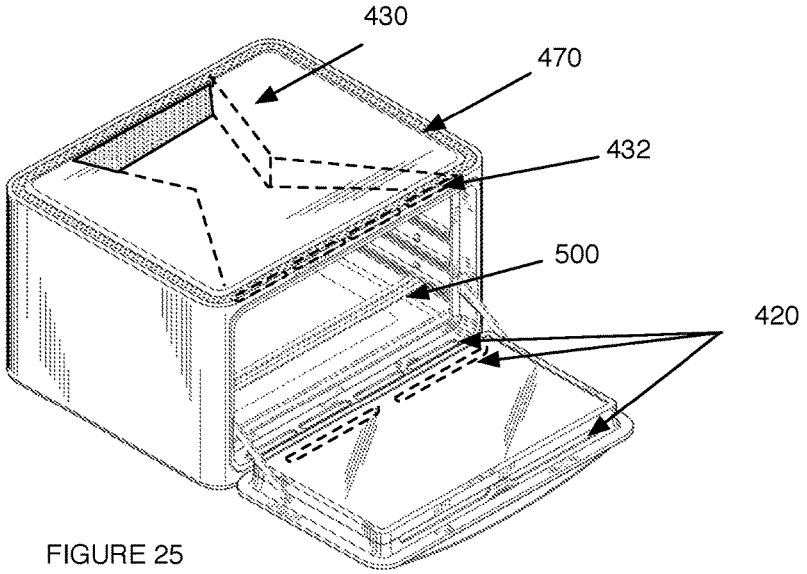
Figure 26:
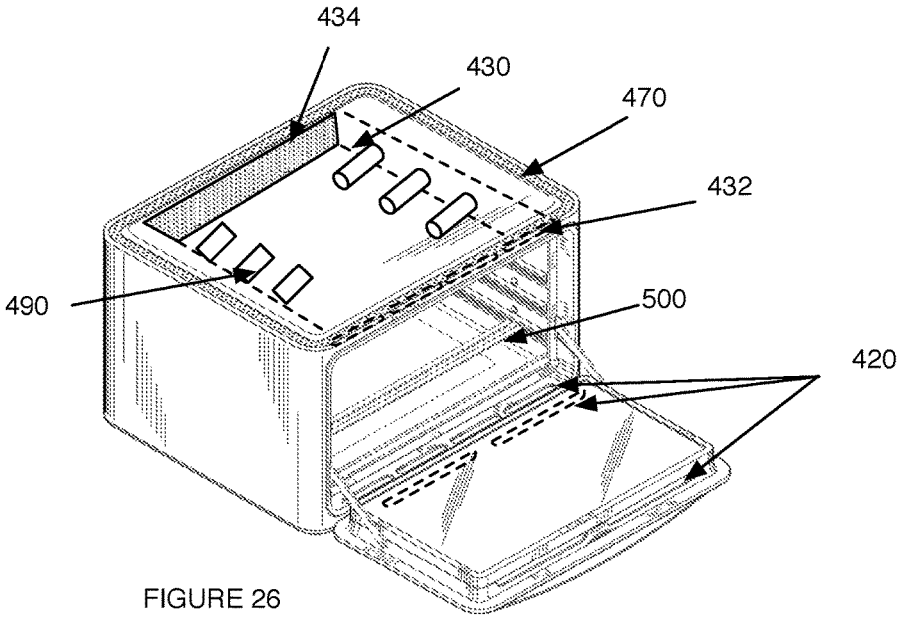
Figure 27:
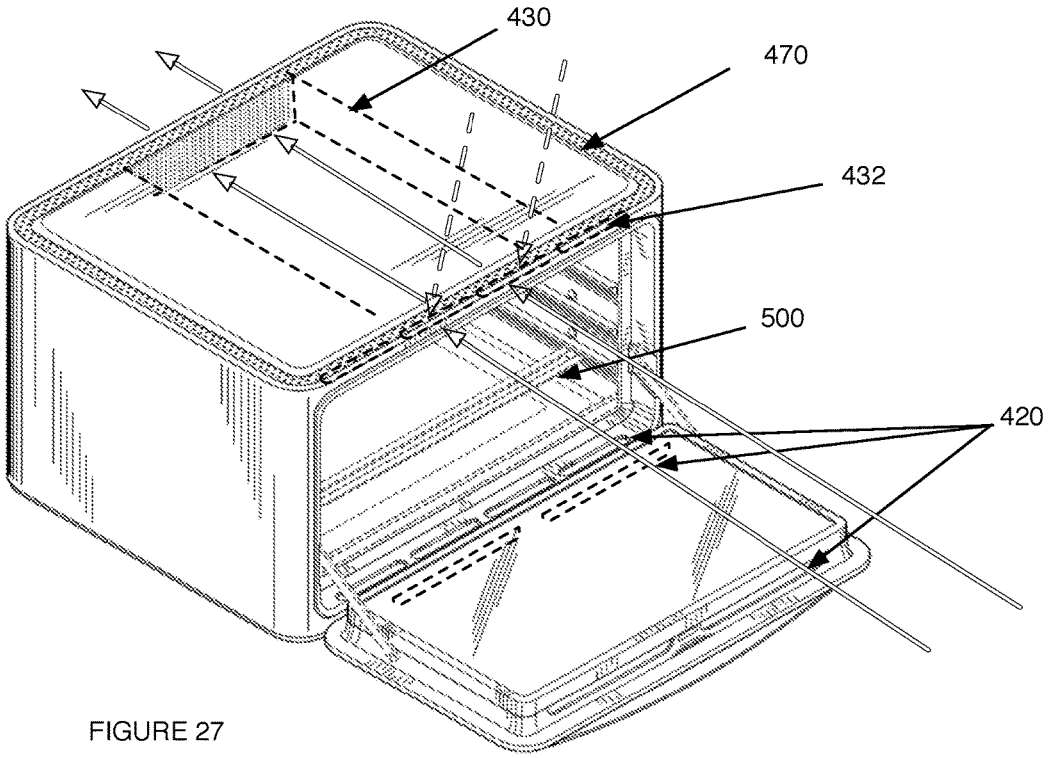
Figure 28:
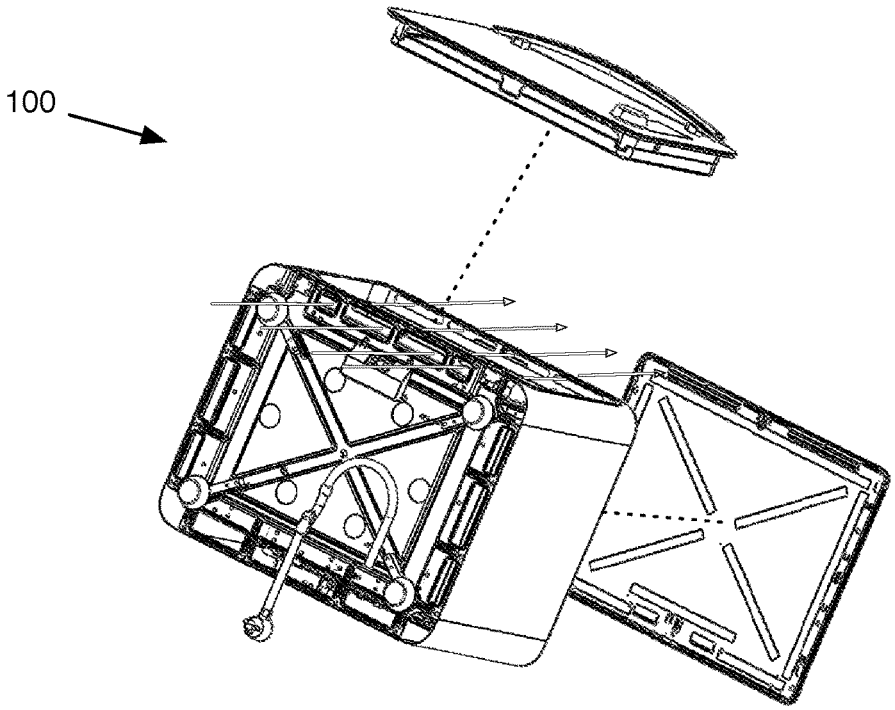
FIGS. 28-30 are perspective views of variations of a specific example of the oven.
Figure 29:
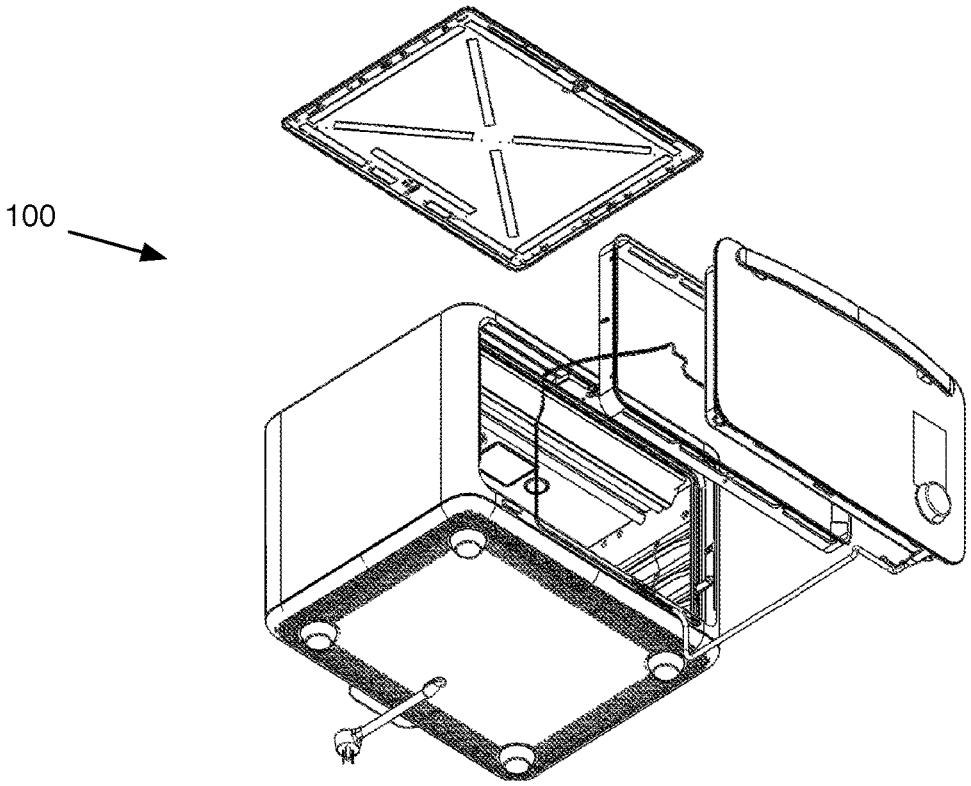
Figure 30:
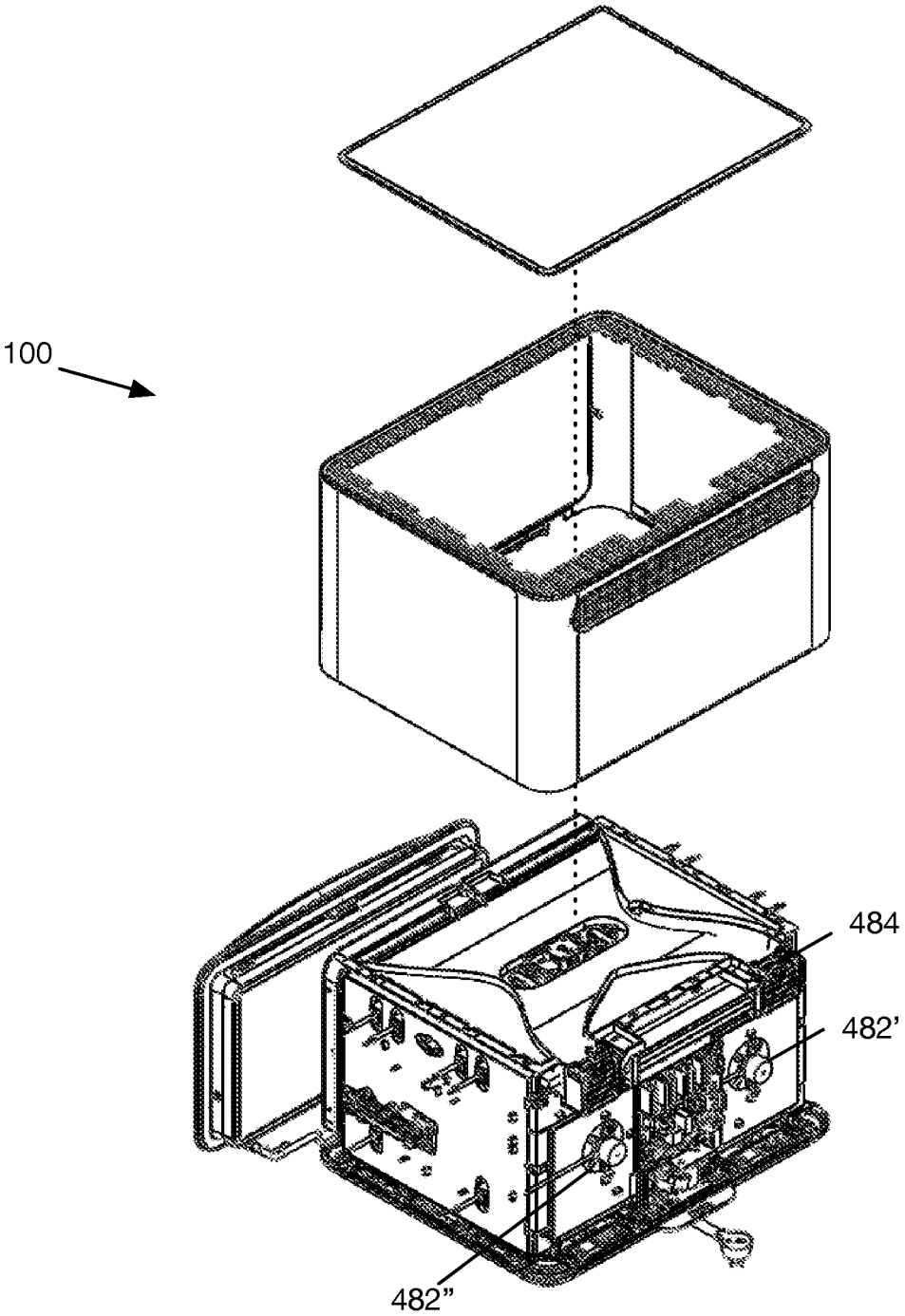

As shown in FIGS. 19-20 and 23, the sensor 310 functions to record cooking parameters. The sensors 310 can include an optical sensor (e.g., camera assembly, image sensors, light sensors, etc.), audio sensors, temperature sensors, volatile compound sensors, weight sensors, humidity sensors, depth sensors, location sensors, inertial sensors (e.g., accelerators, gyroscope, magnetometer, etc.), impedance sensors (e.g., to measure bio-impedance of foodstuff), hygrometers, insertion temperature sensors (e.g., probes), cooking cavity temperature sensors, timers, gas analyzers, pressure sensors, flow sensors, door sensors (e.g., a switch coupled to the door, etc.), power sensors (e.g., Hall effect sensors), or any other suitable sensor 310.

In one variation, the sensor 310 can be a camera assembly. The camera assembly preferably includes a camera electrically connected to (e.g., mounted to) a PCB, but can additionally or alternatively include any suitable component. The camera assembly is preferably arranged within a top fluid channel 430 defined by the exterior and interior panels of a dual-panel oven top 120. In a first variation, the camera assembly can be mounted to the exterior top panel 124. For example, the PCB can be mechanically mounted to the side of the exterior top panel 124 facing the top fluid channel 430, such that the camera can be arranged within the top fluid channel and directed towards the oven bottom 150. In a second variation, the camera assembly can be mounted to the interior top panel 122 with the camera proximal the cooking cavity 105. For example, the PCB can be mounted to the side of the interior top panel 122 facing the top fluid channel 430, and the PCB-mounted camera can extend into the cooking cavity 105. The camera can be recessed away from the cooking cavity 105, flush with the cooking cavity 105, extending into the cooking cavity 105, and/or possess any suitable arrangement with respect to the cooking cavity 105. Components of the camera assembly can be thermally connected to the top fluid channel 430, the cooking cavity 105, and/or any other suitable component of the connected oven 100 (e.g., through the oven panels, directly thermally connected, etc.). Additionally or alternatively, a camera assembly can be arranged within the oven door 110 (e.g., directed with a field of view outward away from the cooking cavity, directed with a field of view inward toward the cooking cavity, etc.), but can otherwise be arranged at any suitable portion of the connected oven 100. The camera assembly preferably defines a field of view directed toward the oven bottom 150 (e.g., if the camera assembly is arranged at the oven top 120), but can additionally or alternatively define a field of view directed towards the oven back 130 (e.g., if the camera is arranged at the oven door no), towards the oven door 110 (e.g., if the camera is arranged at the oven back 130), and/or any other suitable reference point. However, the camera assembly can be otherwise configured.

1.4 Thermal Management System

The thermal management system 400 functions to manage the heat transmission from the cooking cavity 105 to the display 210 or other heat-sensitive component. The thermal management system 400 can additionally function to cool the heat-sensitive component, electrical connections between heat-sensitive components, or other components thermally connected to the heat-sensitive component. The oven preferably includes one or more thermal management systems 400, wherein each thermal management system 400 can manage the thermal exposure of one or more heat-sensitive components. The thermal management system 400 can include fluid channels 410 thermally separating the component from the cooking cavity 105 and/or guiding cooling fluid over the component, thermally insulative materials (e.g., foam, ceramic, etc.) encapsulating or thermally separating the component from the cooking cavity 105. The thermal management system 400 can additionally or alternatively include fluid movement mechanisms and/or include any other suitable thermal management system 400 components. The cooling fluid can be: ambient environment fluid (e.g., air), dedicated cooling fluid (e.g., coolant, supplied from a fluidly connected fluid reservoir), or be otherwise supplied. The cooling fluid can be gas, liquid, or have any other suitable physical state.

1.4.1 Fluid Channel

In a first variation of the thermal management system 400, the thermal management system 400 can include a fluid channel 410, which functions to cool heat-sensitive components (e.g., a user interface unit 200, a control system 300), associated electrical connections, or any other suitable component (e.g., an oven sidewall, thereby facilitating a cool-touch exterior) of the connected oven 100. A fluid channel 410 can be cooperatively defined between the heat-sensitive component and the oven panel. The oven panel can be the primary oven panel, a secondary oven panel, or any other suitable oven panel. In this variation, the oven panel cooperatively defining the fluid channel 410 can include standoffs or cooling features 490 extending from the panel broad face. The cooling features 490 can include fins, grooves, pins, divots, or any other suitable cooling feature 490.

The cooling features 490 preferably extend from the external broad face of the primary oven panel (e.g., face distal the cooking cavity 105) or the internal broad face of the secondary oven panel (e.g., face proximal the cooking cavity 105), but can alternatively extend from any other suitable panel surface. The heat-sensitive component can be mounted to the cooling features 490 (e.g., screwed into, adhered, welded, clipped, etc. to the cooling features 490), mounted directly to the panel, or otherwise affixed to the oven panel.

In this variation, the thermal management system 400 can include a secondary oven panel arranged a predetermined distance away from the primary oven panel, wherein the secondary and primary oven panels cooperatively define a lumen (e.g., a fluid channel 410, fluid manifold) therebetween. The oven door 110, oven back 130, oven top 120, oven bottom 150, sidewalls 140, and/or any other suitable oven component can include a primary and secondary oven panel cooperatively defining a fluid channel 410. The secondary oven panel is preferably arranged external the primary oven panel (e.g., distal the cooking cavity 105), but can alternatively be arranged internal the primary oven panel or be arranged in any other suitable configuration. The secondary oven panel is preferably parallel to the primary oven panel, but can alternatively be arranged at an angle to the primary oven panel (e.g., to facilitate fluid flow in a predetermined direction, similar to a diffuser), or be arranged in any other suitable configuration relative to the primary oven panel. The secondary oven panel is preferably substantially identical to the primary oven panel, but can alternatively be substantially different. The secondary oven panel can be substantially planar, include waves or folds, or have any other suitable configuration. Any suitable region of a secondary or primary panel pair can define a fluid channel 410, fluid inlet, and/or fluid outlet. However, primary and secondary oven panels can have any suitable surface area, volume, and/or other configuration for cooperatively defining a fluid channel 410.

The secondary oven panel can be formed from thermally conductive material, thermally insulative material, or from any other suitable material. The primary and secondary oven panels can be constructed using similar materials, different materials, and/or any other material configuration. The secondary oven panel can include cooling features 490 along the internal face (e.g., the face proximal the primary oven panel) or the external face (e.g., the face distal the primary oven panel). The secondary oven panel can be coextensive with the primary oven panel, extend beyond the primary oven panel, or be smaller than the primary oven panel.

Figure 3:
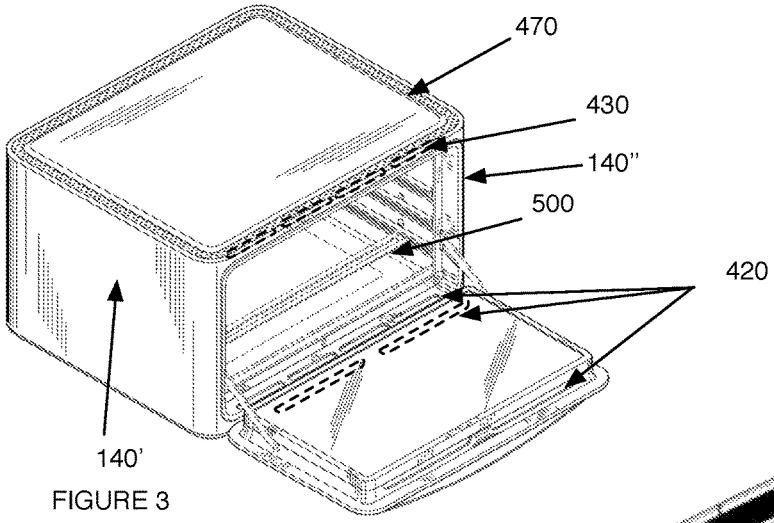
FIG. 3 is a perspective view of the variation of the oven with the door in an open configuration.
Figure 5:
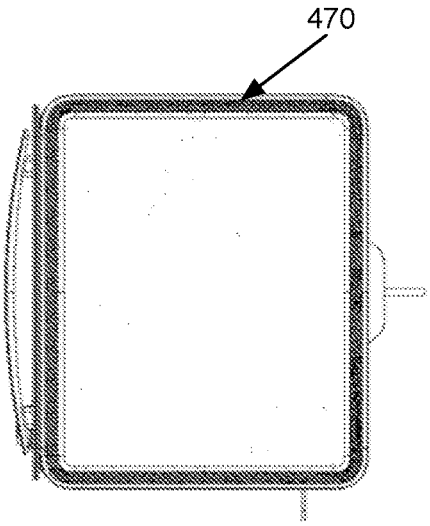
FIG. 5 is a plan view of the top of the variation of the oven.
Figure 6:
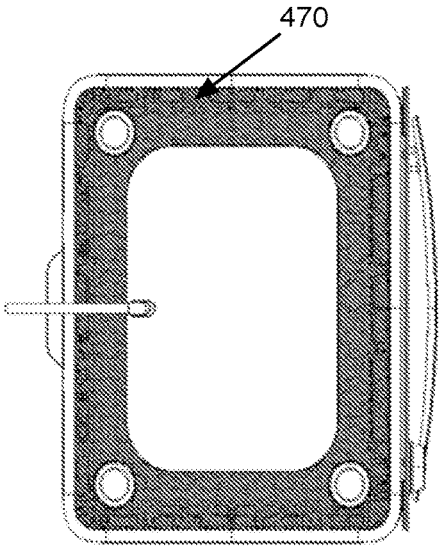
FIG. 6 is a plan view of a bottom of the variation of the oven.
Figure 7:
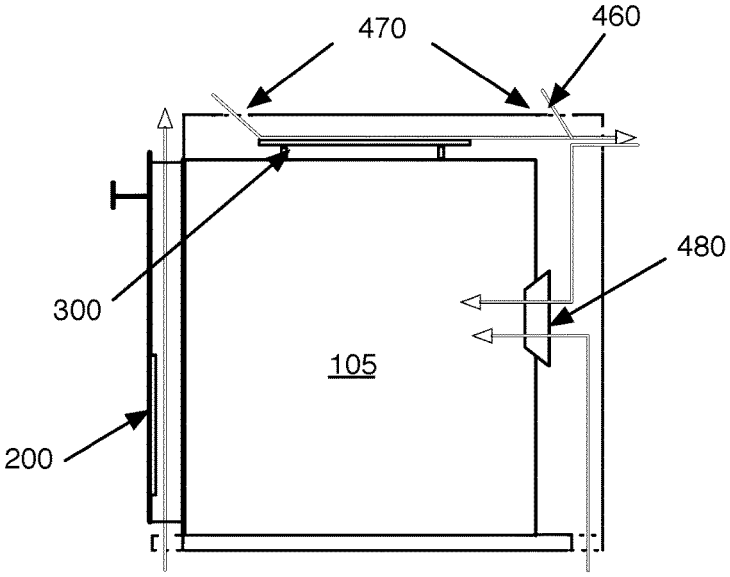
FIG. 7 is a schematic representation of fluid flow through the fluid channels.
Figure 8:
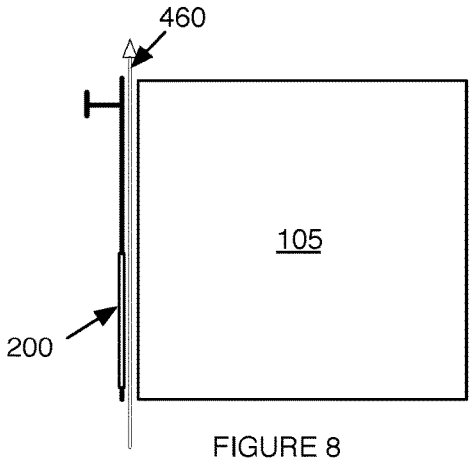
FIGS. 8 to 18 are schematic representations of various fluid flow patterns through the oven.
Figure 9:
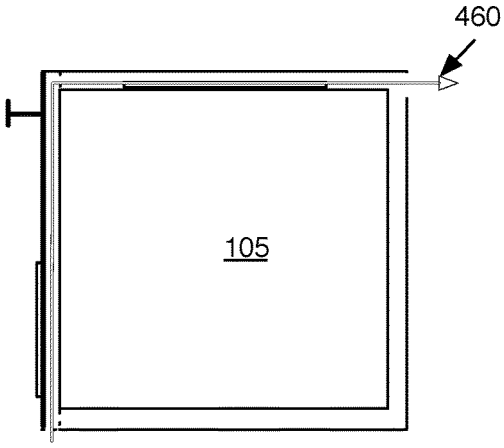
Figure 10:
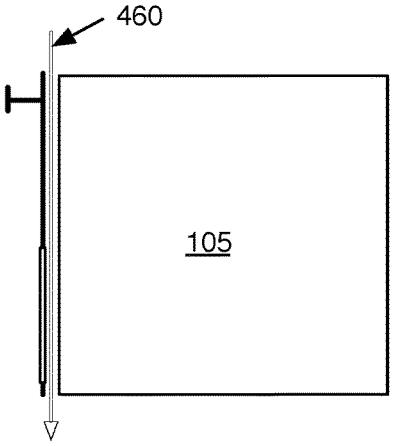
Figure 11:
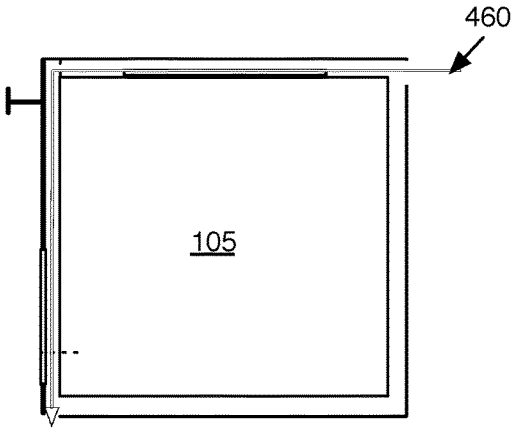
Figure 12:
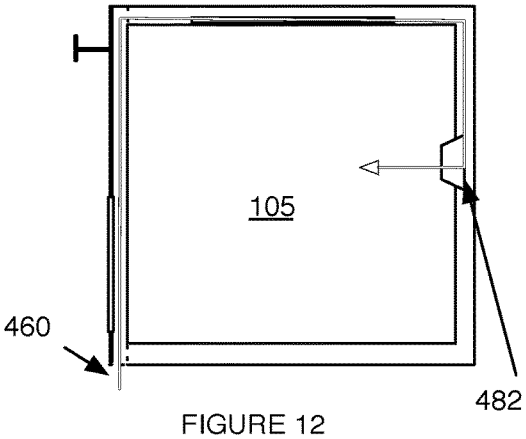
Figure 13:
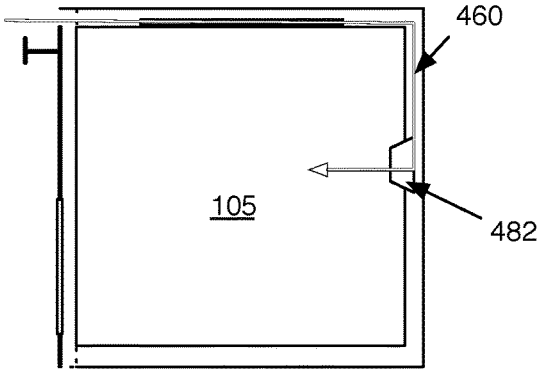
Figure 14:
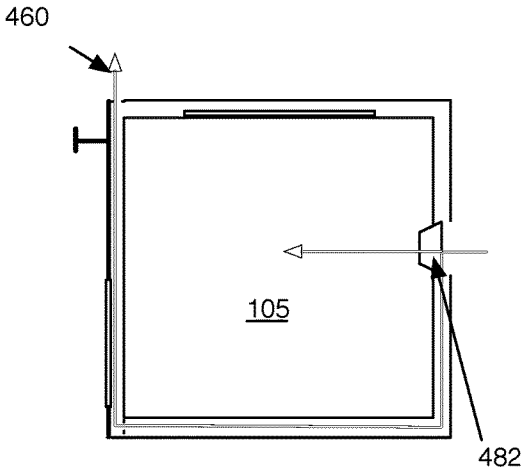
Figure 15:
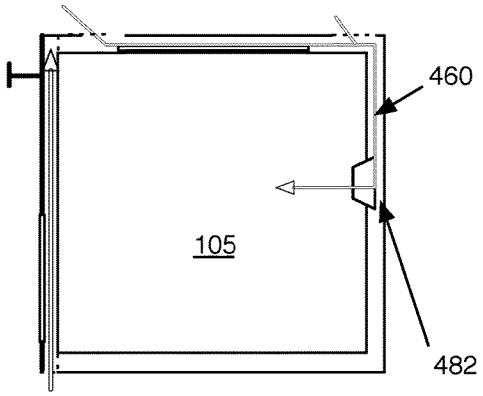
Figure 16:
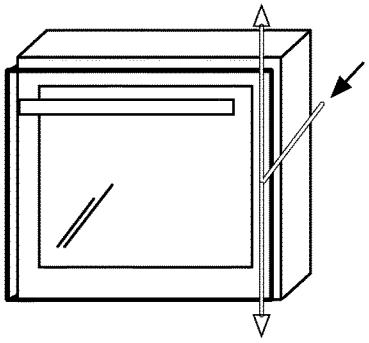
Figure 17:
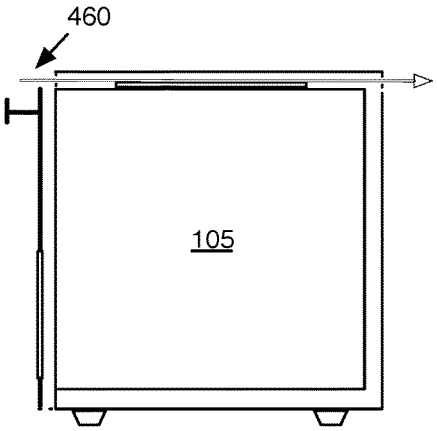

As shown in FIG. 19, the secondary oven panel can additionally define external fluid connections 470 (e.g., a fluid inlet into a fluid channel 410, a fluid outlet, an external fluid connection 470 acting as both a fluid inlet and a fluid outlet, etc.). For example, the secondary oven panel can define perforations through the panel thickness (e.g., as shown in FIGS. 5 and 6), define air gaps through the panel thickness (e.g., as shown in FIG. 3), cooperatively define air gaps with adjacent secondary oven panels, or include any other suitable external fluid connection 470 fluidly connecting a secondary oven panel exterior with the fluid channel 410.

In this variation, heat-sensitive components can be arranged within the fluid channel 410, but can alternatively be mounted outside the fluid channel 410. The heat sensitive component can be mounted to or form a portion of the secondary oven panel, primary oven panel, an intermediary panel arranged between the primary and secondary wall panels, or to any other suitable mounting point. The heat sensitive component can be mounted to the broad face of the oven panel, a cooling feature 490 extending from the oven panel broad face, or be mounted to any other suitable portion of the oven panel. Specific examples of heat sensitive component mounting configurations include: heat sensitive component mounting to the exterior of the secondary panel (e.g., to the face of the secondary oven panel distal the cooking cavity 105), forming a portion of the secondary oven panel, mounting to the interior of the secondary oven panel (e.g., wherein the secondary oven panel is transparent), mounting to the exterior of the primary oven panel (e.g., to the face of the primary oven panel distal the cooking cavity 105), mounting to the interior of the primary oven panel, forming a portion of the primary oven panel, or mounting to any other suitable oven wall.

As shown in FIGS. 7-18, in this variation, a fluid channel 410 can define a fluid vector 460 (e.g., extending along a fluid path; flow axis, etc.) describing directionality and magnitude of fluid moving through a fluid channel 410. Fluid vectors 460 can possess any suitable velocity, acceleration, directionality, and/or other suitable fluid vector characteristic. Further, a fluid channel 410 can define multiple fluid vectors 460, each having similar or different fluid vector 460 characteristics from other fluid vectors 460 defined by a same or different fluid channel 410. Fluid vector characteristics can be affected by the configuration of associated: fluid channels 410, cooling features 490, oven panels, temperature, pressure, fluid movement mechanisms, and/or other oven components. In one example, a processing system 320 of the connected oven 100 can be leveraged to control fluid movement mechanisms (e.g., by controlling operation of convection elements, by controlling temperature of the cooking cavity, etc.), thereby affecting fluid vectors characteristics. However, fluid vectors 460 and flow axes can have any suitable characteristic.

In a first embodiment of the first variation, the lumen can be fluidly sealed, wherein the lumen can retain a thermally insulative material (e.g., foam, air, ceramic, etc.). Alternatively, the lumen can be a vacuum chamber, wherein the primary and secondary panels cooperatively form a vacuum panel. In this variation, the heat-sensitive component can be mounted to the exterior of the oven wall (e.g., to the secondary oven panel, distal the cooking cavity 105), but can alternatively form a portion of the secondary oven panel, be mounted to the interior of the secondary oven panel (e.g., wherein the secondary oven panel is transparent), or be mounted to any other suitable position.

In a second embodiment of the first variation, the lumen can form the body of a fluid channel 410, wherein the first and/or second oven panel can additionally define one or more channel openings. The channel opening plane can be perpendicular to the fluid channel 410, parallel the fluid channel 410, or arranged at any other suitable angle to fluid channel 410. The channel openings can be defined by the primary and secondary panel ends, be defined through the thickness of the primary and/or secondary panel (e.g., by the external fluid connections 470), be defined by a secondary or primary panel end and an adjacent wall panel, be defined along the body of a panel (e.g., the secondary oven panel), or be otherwise defined.

In a third embodiment of the first variation, the thermal management system 400 can include multiple fluid channels 410 fluidly isolated from one another. For example, a door fluid channel 420 (e.g., defined by a dual-panel oven door 110) can be fluidly isolated from a top fluid channel 450 (e.g., defined by a dual-panel oven top 120), such that fluid traveling through the door fluid channel 420 is isolated from fluid traveling through the top fluid channel 430. Fluid isolation between fluid channels 410 is preferably achieved through physical walls 138 separating the fluid channels 410. However, fluid channels 410 can otherwise be fluidly isolated from each other.

In a fourth embodiment of the first variation, the thermal management system 400 can include multiple fluid channels 410 fluidly connected with one another. For example, a door fluid channel 420 can be fluidly connected with a top fluid channel 430, such that fluid traveling through the door fluid channel 420 can be redirected into the top fluid channel 430. However, fluid channels 410 can be otherwise fluidly connected.

In a fifth embodiment of the first variation, the thermal management system 400 can include a third, or intermediary, oven panel (e.g., in addition to the secondary panel). The third oven panel can function to separate the lumen defined by the primary and secondary oven panels into a first and second lumen (e.g., a first and second fluid channel). The first and second lumens can function to increase heat-sensitive component cooling, enable cross-current flow (e.g., wherein fluid flows in a first direction through the first lumen and in an opposing or different direction through the second lumen), or enable any other fluid flow. The third oven panel can additionally function as a mounting point for the heat-sensitive components, and can additionally include cooling features 490 and/or external fluid connections 470, similar to those discussed above. The third oven panel can be substantially similar to the primary and/or secondary panels, or be different. For example, the third oven panel can be a portion of the heat-sensitive component. The third oven panel can be coextensive with the primary and/or secondary panels, but can alternatively be longer, shorter, or have any other configuration. However, the thermal management system 400 can include any suitable number of oven panels, dividing a fluid channel 410 into any number of fluid sub-channels possessing any suitable fluid channel characteristic.

1.4.1.a Fluid Channel—Oven Door

In a sixth embodiment of the first variation, the door can be a dual-panel door including an interior door panel 112 and an exterior door panel 114 cooperatively defining a door fluid channel 420 therebetween. The door fluid channel 420 is preferably defined by a gap extending along the door longitudinal axis (e.g., extending from the bottom to the top), but can include a gap extending along the door lateral axis, along an axis normal to the door broad face, or extending along any other suitable portion of the oven door no. The door fluid channel 420 preferably fluidly separates the user interface unit 200 and control system 300 (e.g., processing system 320) from the cavity interior and/or inner door panel, but can fluidly separate any suitable oven components.

In this embodiment, the interior door panel 112 can cooperatively define the cooking cavity 105 with the oven body. The interior and the exterior door panel 114 each preferably include a transparent window coextensive with the cooking cavity, where the transparent windows preferably have substantially similar visual transmittance. However, the interior and exterior door panels 114 can have include any suitable materials with any suitable optical characteristics.

The exterior door panel 114 can additionally or alternatively define a user interface mounting region 116 (e.g., where components of the user interface unit 200 can be mounted) thermally connected to the door fluid channel 420. As shown in FIG. 21, for example, the user interface unit 200 can be mounted to a mounting region 116 of the transparent window of the exterior door panel 114, where the mounting region 116 can be offset from an edge of the exterior door panel 114. In this example, a transparent region 118 of the transparent window can be arranged between the mounting region 116 and the edge of the exterior door panel 114, where the transparent region 118 can thermally insulate the user interface unit 200 from the door panel edge (e.g., which can include a thermally conductive metal bezel 160). In one specific example, the transparent window of the exterior door panel 114 can include glass, and the transparent region 118 of the transparent window can thermally insulate the user interface unit 200 from a metal bezel 160 of the oven door 110. However, the interior door panel 112 and/or other oven panel can additionally or alternatively define user interface mounting regions 116. Further, user interface mounting regions 116 can be otherwise configured.

The interior and/or exterior door panels 114 can additionally or alternatively include one or more bezels 160 coextensive with, defining, supporting, or otherwise associated with the edges of the door panel. The bezel 160 is preferably metal, but can additionally or alternatively include any other suitable material. Electrical wiring connecting components of the connected oven 100 (e.g., connecting a processing system 320 with a camera assembly and a wireless communication system) can run along regions of the bezel 160. In a specific example, a processing system 320 is mounted to the user interface unit 200 arranged at the exterior door panel 114, and electrical wiring can run from the processing system 320, along the bezel 160 to the oven top 120, and to a camera assembly arranged at the oven top 120. However, bezels 160 of the oven door 110 can be otherwise configured.

The door fluid channel 420 can include a door fluid channel inlet 422 and a door fluid channel outlet 424. The door fluid channel inlet 422 can facilitate fluid access from the ambient environment to the door fluid channel 420, and the door fluid channel inlet 422 can enable fluid to access the ambient environment from the door fluid channel 420. The door fluid channel 420 preferably includes at least one door fluid channel inlet 422 proximal the oven bottom 150, and at least one door fluid channel outlet 424 proximal the oven top 120, but door fluid channel inlets 422 and/or outlets 424 can be otherwise located. In examples where the oven door 110 includes a metal bezel 160, the metal bezel 160 can extend about edges of the exterior door panel 114, where the metal bezel 160 cooperatively defines an inlet 422 of the fluid channel and an outlet 424 of the fluid channel. Alternatively, the metal bezel 160 can define either a door fluid channel inlet 422 or a door fluid channel outlet 424, but can be otherwise related to any suitable inlet or outlet. The fluid channel 420 preferably defines a flow axis substantially parallel a normal vector of the oven base 152 when the oven door 110 is in the closed position . . . . Further, a plane of the door fluid channel inlet 422 and/or outlet can be perpendicular a door flow axis 426 defined by the door fluid channel 420, parallel the door flow axis 426, or otherwise oriented.

The door fluid channel 420 can be open along a first and a second opposing side (e.g., the sides parallel the longitudinal axis of the door, or the sides aligned along a gravity vector), but can additionally or alternatively be open along a third and fourth opposing side (e.g., the sides orthogonal to the first and second sides), be open along adjacent sides, or be open along any other suitable portion. Additionally or alternatively, the sides can be sealed, include perforations, or include any other suitable feature.

In a first example of the sixth embodiment, the inlet of the door cooling channel can be fluidly connected to fluid inlets and/or outlets in the oven bottom 150, wherein the air inlets can be perforations formed through the oven bottom panel 150 and be substantially aligned with the door longitudinal axis. The oven bottom 150 can extend beyond the interior door panel 112, such that the cooling channel inlet is arranged within the boundaries of the oven bottom panel 150. In a specific example, the oven bottom 150 defines a front edge nested under the oven door 110 when the oven door 110 is in the closed position, where the front edge defines an external fluid connection (e.g., perforations, channels, inlets, outlets, etc.) aligned with a door fluid channel inlet 422. The external fluid connection can extend through the entirety of the thickness of the oven bottom, through a portion of the oven bottom thickness (e.g., and terminate along a face perpendicular to the oven bottom broad face), or extend along any suitable axis. The external fluid connection can define an external opening, fluidly connecting the external fluid connection to the ambient environment, and a fluid channel opening, fluidly connecting the external fluid connection to the door fluid channel (e.g., the door fluid channel inlet). The external opening and/or fluid channel opening can be arranged: perpendicular the oven broad face, parallel the oven broad face (e.g., defined by the oven broad face), or otherwise defined. However, the oven bottom 150 can be fluidly connected with the door fluid channel 420 in any suitable manner. The outlet(s) of the door fluid channel 420 can be defined by external fluid connections (e.g., similar to those described for the oven bottom external fluid connections, alternatively different) located in a region of the oven top 120 extending over the top of the oven door 11*o* when the door is in a closed position (e.g., such that the oven door nests under the oven top overhang 128). Additionally or alternatively, the door fluid channel 420 can be fluidly connected to top fluid channel inlets 432 in the oven top 120, wherein the air inlets can be air manifolds, apertures, or other inlets formed through an interior oven top 120 panel. The air inlets can be substantially aligned with the door longitudinal axis. In this example, the oven top 120 preferably extends beyond the interior door panel 112, such that a door fluid channel outlet 424 is arranged within the boundaries of the oven top panel 120. Additionally or alternatively, the door fluid channel outlet can be open to the ambient environment when the door is sealed (e.g., in a closed position).

In a second example of the sixth embodiment, the door fluid channel 420 is open to the ambient environment when the door is sealed (e.g., in a closed position). In this example, the primary door panel 112 can seal to the ends of the top 120, bottom 150, and sidewall panels 140. The secondary and primary door panels 112 are preferably coextensive, but the secondary or primary door panel 112 can alternatively be shorter than the other.

In a third example of the sixth embodiment, the door fluid channel 420 can be fluidly connected to a second fluid channel when the door is sealed, such that the secondary door panel 114 seals to a secondary panel of the top, bottom, and/or sidewalls 140, and the primary door panel 112 seals to a primary panel of the top, bottom, and/or sidewalls 140. In this example, the secondary door panel 114 can extend beyond the primary door panel 112 to form the fluid connection. Alternatively, the secondary and primary door panels 112 can be coextensive, wherein the primary door panel 112 can include external fluid connections 470 (e.g., perforations) that fluidly connects the door fluid channel 420 (defined between the door panels) to the second fluid channel. However, the door fluid channel 420 can be otherwise connected to the second fluid channel.

1.4.1.b Fluid Channel—Oven Top

In a seventh embodiment of the first variation, the oven top 120 can be dual-panel, including an interior top panel 122 and an exterior top panel 124 cooperatively defining a top fluid channel 430 therebetween. In this embodiment, the interior top panel 122 can cooperatively define a cooking cavity 105 with an oven back 130, oven bottom 150, and/or any other suitable component. Additionally or alternatively, the interior and/or exterior top panel 124 can include a set of cooling features 490 extending from the broad face distal the cooking cavity 105 into the fluid channel 430.

Additionally or alternatively, the interior and/or exterior top panel 124 can include a set of cooling features 490 extending from the broad face distal the cooking cavity 105 into the fluid channel 430.

In this embodiment, a control system 300 (e.g., a camera assembly) is preferably arranged within the top fluid channel 430. In a specific example, a camera assembly can be arranged within the top fluid channel 430, and the camera assembly can be thermally connected to the top fluid channel 430. In this specific example, the camera assembly can be mounted to the interior top panel 122, such as if the camera assembly is mounted to a cooling feature 490 of the interior top panel 122 extending from a broad face of the interior top panel 122. Additionally or alternatively, the camera assembly can be directly mounted to the interior top panel 122, to the exterior top panel 124, and/or any other suitable component of the connected oven 100.

The oven top 120 can additionally or alternatively include an intermediary panel, mounted within the top fluid channel, to the cooling features 490. The control system 300 can be mounted to the intermediary panel within the fluid channel 430, along a broad face of the intermediary panel distal the primary top panel 122. The fluid channel 430 can include a first and second opposing end. The control system 300 can be mounted to along the center of the fluid channel 430, along the fluid channel end proximal the ambient environment, along the fluid channel end distal the ambient environment, or along any other suitable portion of the fluid channel 430.

Figure 31:
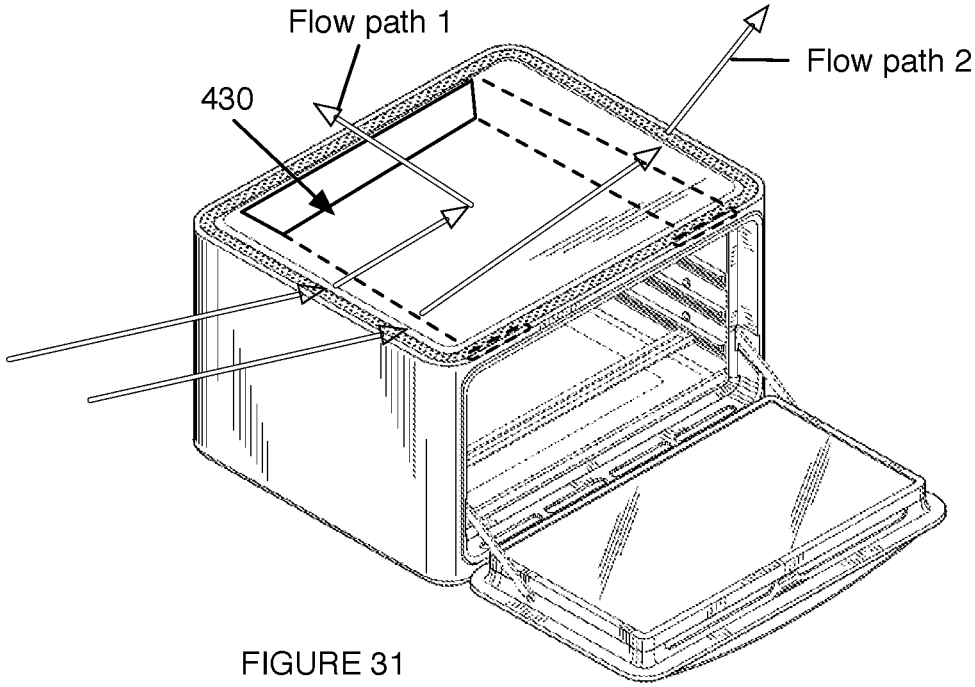
FIG. 31 is a schematic representation of a specific example of a first and a second flow path through the oven.

The top cooling channel 430 preferably includes a top fluid channel inlet 432 (e.g., facilitating fluid access from the ambient environment to the top fluid channel) and an outlet (e.g., facilitating fluid flow from top fluid channel to the ambient environment). The top cooling channel inlet 430 can be defined by perforations, air gaps, and/or other external fluid connections 470 in the exterior top panel 124 and/or the interior top panel 122. Additionally or alternatively, a top fluid channel inlet 432 can be fluidly connected to the door fluid channel outlet 424 (e.g., when the door is in the closed position), wherein fluid from the door fluid channel 420 preferably enters through the interior oven top 120 panel and is entirely or partially redirected by the exterior oven top 120 panel into the top cooling channel 430. Alternatively, the door fluid channel 420 can be fluidly isolated from the top fluid channel inlet 432. As shown in FIG. 31, in specific examples, the oven top 120 can define inlets and/or outlets (e.g., perforations, air gaps, etc.) for channels directing fluid through a flow path beginning proximal an oven side wall 140'. For example, the exterior top panel 124 can define fluid inlet perforations arranged proximal an oven side wall 140. Fluid entering in through such perforations can enter a flow path directing the fluid through the outlets proximal an opposing oven side wall 140", through the top cooling channel 430, and/or through channel outlets defined at any portion of the oven top 124 (e.g., at a central region of the exterior top panel 124) and/or the connected oven 100. As shown in FIG. 31, the flow paths of the specific examples are preferably perpendicular and/or coplanar with flow paths for fluid entering the top cooling channel 430 at a top fluid channel inlet 432 arranged proximal the oven door 110, and moving towards the oven back 130. However, the flow paths of the specific examples can be parallel, non-coplanar, co-axial, non-coaxial, angled, and/or have any suitable orientation with respect to other fluid flow paths and/or components of the connected oven 100. However, fluid paths through the oven top 120 can be otherwise configured.

Figure 4:
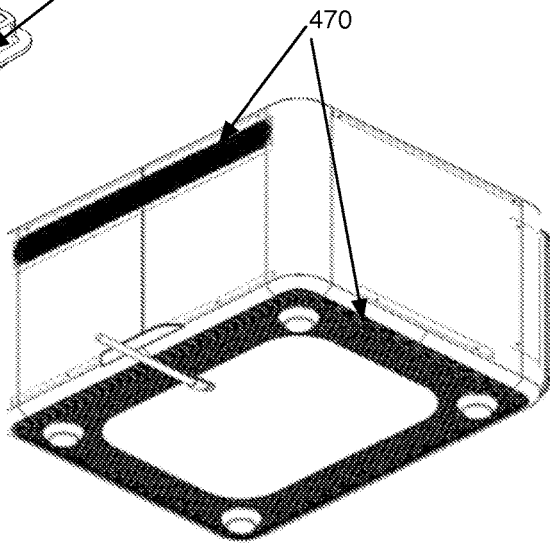
FIG. 4 is a perspective view of a back of the variation of the oven.

As shown in FIG. 4, the top cooling channel 430 outlet can fluidly connect to the ambient environment through an air outlet arranged proximal the oven back 130 (e.g., defined by the oven back 130 panel, wherein the air outlets can be perforations formed through the oven back 130 panel). Additionally or alternatively, the top fluid channel outlet 434 can be defined by external fluid connections 470 (e.g., perforations, air gaps, etc.) at the exterior top panel 124 and/or interior top panel 122, where the external fluid connections 470 are arranged proximal the oven back 130. The top cooling channel 430 preferably defines a substantially linear flow path having a longitudinal axis. In examples where the air outlets are defined by the oven back 130, the air outlets can be substantially aligned with the top cooling channel 430 longitudinal axis (e.g., have a normal vector arranged perpendicular the door longitudinal axis). A control system 300 (e.g., a camera assembly) is preferably arranged at the top fluid channel 430 between a top fluid channel inlet 432 and a top fluid channel outlet 434. Additionally or alternatively, a user interface unit 200 component and/or any other suitable component can be arranged between a top fluid channel inlet 432 and outlet. However, the top cooling channel 430 outlets can be otherwise configured.

A flow axis of the top fluid channel 430 is preferably substantially parallel a normal vector of the oven back 130. Further, a plane of the top channel inlet 432 is preferably parallel a top flow axis defined by the top fluid channel 430. Additionally or alternatively, the top fluid channel 430 and the door fluid channel 420 can be fluidly isolated (e.g., by an isolation wall connecting the interior top panel 122 with the exterior top panel 124. A plane of the isolation wall (e.g., a broad face) can be oriented parallel a cooking cavity opening plane, perpendicular the cooking cavity opening plane, at an angle to the cooking cavity opening plane, and/or oriented in any suitable fashion. However, fluid flow through the top fluid channel 430 can be otherwise configured.

As shown in FIGS. 23-27, the top cooling channel 430 can be shaped and vary along the longitudinal axis and/or flow path, or be substantially straight with a constant cross section. For example, the top cooling channel 430 can converge (e.g., decrease in cross section) toward an intermediate region, then diverge (e.g., increase in cross section) toward the top cooling channel 430 outlet. Alternatively, the top cooling channel 430 can converge (e.g., decrease in cross section) toward an intermediate region, then split into multiple streams from the intermediate region toward the top cooling channel 430 outlet. However, the top cooling channel 430 can include any other suitable set of features (e.g., flow shaping features, cooling features 490, etc.) along the flow path. The sensors 310, emitters, or other heat-sensitive components (or components requiring cooling) are preferably arranged in the intermediate region, but can be otherwise arranged. The flow from the oven bottom 150, through the oven door 110, along the oven top 120, and out the oven back 130 is preferably driven by convection fans arranged proximal the oven back 130 and directed to blow air out the air outlets in the back panel (e.g., wherein the fans can be arranged along the oven exterior or arranged within the lumen formed by the exterior oven panels), but can be supplemented or entirely driven by natural convection or by any other suitable force.

As shown in FIGS. 19 and 20, in a first example of the seventh embodiment, the first top fluid channel end (e.g., a front end proximal the oven door 110) can be fluidly isolated from direct fluid connection with the door fluid channel 420, and include a substantially solid end. As shown in FIG. 5, in this example, the first fluid channel end can be defined by perforations or air gaps through the exterior top panel (e.g., along the top panel perimeter). Additionally or alternatively, in this example, the oven door 110 can be nested under an overhang 128 defined by the oven top 120, where a top interior panel region coextensive with the overhang 128 can include both perforated and solid portions. The perforated portion of the top interior panel region can be aligned with the door fluid channel 420, where a top exterior panel region coextensive with the overhang 128 can be perforated. In this example, an isolation wall fluidly isolating the door fluid channel 420 from the top fluid channel 430 can be aligned with a transition region between the perforated and the solid portions of the top interior panel region.

In a first variation of the first example, the exterior top panel 124 can be perforated along the entire length of the exterior top panel 124 coextensive with the overhang 128. The region of the interior top panel 122 coextensive with the overhang 128 can include fluid-permeable (e.g., perforated) and/or fluid-impermeable (e.g., solid) sections.

Fluid permeable sections are preferably aligned with door fluid channel openings (e.g., inlets or outlets), such that the fluid-permeable region between the interior top panel 122 and the exterior top panel 124 defines (e.g., cooperatively forms) a first fluid manifold connecting the door fluid channel 420 to the ambient environment. However, the door fluid channel 420 can be otherwise connected to the ambient environment. The first fluid manifold can be further cooperatively defined by a wall (e.g., a front wall 126, isolation wall) extending between the interior top panel 122 and exterior top panel 124, where a plane of the wall is preferably parallel to a plane of the opening to the cooking cavity 105. However, the wall can be otherwise oriented, and any suitable oven component can cooperatively define the first fluid manifold.

In this first variation, a fluid impermeable section of the interior top panel (e.g., impermeable to fluid from the door fluid channel 420) is preferably aligned with top fluid channel opening(s), wherein the region between the interior and exterior top panels 122, 124 at the fluid impermeable section define (e.g., cooperatively form) a second fluid manifold fluidly connecting the top fluid channel 430 to the ambient environment (e.g., through the perforations in the exterior top panel). However, any suitable oven component can cooperatively define the second fluid manifold. The first and second fluid manifolds are preferably fluidly isolated by a manifold wall extending along the interface between the first and the second fluid manifolds. The manifold wall can be oriented with a plane perpendicular a cavity opening plane, at an angle to the cavity opening plane, or oriented in any suitable fashion. The manifold wall(s) can be a continuation of the front wall 126 (isolation wall), contiguous with the front wall 126, separate from the front wall 126, or otherwise arranged relative to the front wall 126. Fluid permeable sections can be arranged along the overhang 128 in any suitable configuration. For example, the fluid permeable and impermeable sections can alternate along the overhang 128, such as where the interior panel cooperatively defines a configuration of permeable—impermeable—permeable sections along the overhang 128 from one side wall 140' to another other side wall 140" (specific example shown in FIG. 19). In another example, permeability along the overhang 128 is biased toward a single side of the connected oven 100 (e.g., the interior top panel 122 is permeable along the connected oven side that is proximal the user interface unit 200 if the user interface unit 200 is mounted more proximal a given oven side wall 140' relative the other oven side 140"). However, the permeable and impermeable sections can be otherwise arranged and/or configured.

In a second variation of the first example, the external top panel is blind (solid) along regions of the overhang 128 aligned with a door fluid channel outlet 424, such that the door fluid channel exhaust is redirected towards an interior of the cooking cavity 105, to the oven sidewalls 140, and/or any other suitable oven component.

In a second example of the seventh embodiment, the first fluid channel end can be fluidly connected to the door fluid channel 420.

In a third example of the seventh embodiment, the door fluid channel opening can be directly fluidly connected to the ambient environment, wherein the door terminates short of the secondary or primary top panel 122. In this example, the first end can include perforations, other external fluid connections 470, or be unobstructed.

In a fourth example of the seventh embodiment, the second end can be fluidly connected to the ambient environment by an air gap or perforations defined by the back panel.

In a fifth example of the seventh embodiment, the second end can be fluidly connected to the ambient environment by perforations or air gaps defined along the second top panel perimeter.

In a sixth example of the seventh embodiment, the second end can be fluidly connected to a back fluid channel 440 defined by a primary and secondary panel of the back wall. However, the top fluid channel 430 can be fluidly connected to the ambient environment along the second top panel perimeter or be fluidly connected to the ambient environment in any other suitable manner. Additionally or alternatively, the oven top 120 can include any other suitable thermal insulation or cooling feature 490 in any other suitable configuration.

1.4.1.c Fluid Channel—Sidewalls

In an eighth embodiment of the first variation, one or more sidewalls 140 of the oven can be dual-panel, including an interior side panel 142 and an exterior side panel 144 cooperatively defining a side fluid channel 450 therebetween. In this embodiment, the interior side panel 142 can cooperatively define a cooking cavity 105 with an oven back 130, oven bottom 150, and/or any other suitable component.

The exterior and/or interior side panels 142 preferably include molded insulation. Molded materials for thermal insulation can include: molded fiberglass, molded foam, low density materials, high density materials, skinned materials, and/or any other suitable material. However, any suitable oven component can include molded insulation possessing any suitable properties.

The side fluid channel 450 preferably includes a side fluid channel inlet 452 and a side fluid channel outlet 454. The side fluid channel inlet 452 is preferably arranged proximal the oven bottom 150, where the inlet can be cooperatively defined by the interior and exterior side panels 144 (e.g., an air gap defined by the side panels), by external fluid connections 470 (e.g., perforations, air gaps, etc.) defined by edges of the oven bottom 150 extending below an oven side wall 140 (e.g., as shown in FIG. 6), by external fluid connections 470 defined by the exterior side panel 144, and/or by any other suitable region of an oven component. However, the side fluid channel inlets 452 can be otherwise configured.

The side fluid channel outlet 454 is preferably arranged proximal the oven top 120, where the outlet can be defined by the interior and/or exterior side panels 144, by external fluid connections 470 defined by a panel of the oven top 120 (e.g., perforations defined by an exterior top panel 124 bezel 160 arranged along the edges of the exterior top panel 124), and/or by any suitable region of any suitable oven component. However, the side fluid channel inlets 452 can be otherwise configured.

A flow axis of the side fluid channel 450 is preferably parallel a flow axis of the door fluid channel 420 when the door is in a closed position. For example, fluid flowing through the side fluid channel 450 can enter the channel through a side fluid channel inlet 452 proximal the oven bottom 150, and exit the channel through a side fluid channel outlet 454 proximal the oven top 120. However, flow of the side fluid channel 450 can be otherwise configured.

A heat-sensitive component (e.g., an antenna of a wireless communication system) can be thermally connected to, fluidly connected to, and/or arranged within the side fluid channel 450 in between a side fluid channel inlet 452 and a side fluid channel outlet 454. However, any suitable heat-sensitive component can have any suitable relationship with the side fluid channel 450.

In a first example of the eighth embodiment, the side fluid channel 450 can be fluidly connected with other fluid channels (e.g., a top fluid channel 430, a door fluid channel 420, etc.). In one specific example, a side fluid channel outlet 454 can be fluidly connected to a top fluid channel inlet 432, such that fluid exiting the side fluid channel 450 can enter the top fluid channel 430. In a second example of the eighth embodiment, the side fluid channel 450 can be fluidly isolated from one or more fluid channels.

However, side fluid channels 450 can be otherwise configured.

1.4.2 Fluid Movement Mechanism

In a second variation of the thermal management system 400, the thermal management system 400 can additionally include a fluid movement mechanism that functions to move cooling fluid through the fluid channels 410. The cooling fluid can be gas, liquid, a phase change material, or be any other suitable cooling fluid. The cooling fluid can be supplied from a fluid source. The fluid source can be the ambient environment, a fluid container, or be any other suitable fluid source.

In a first embodiment of the second variation, fluid is passively moved through the fluid channels 410 through natural convection. For example, heat rise can drive fluid flow through the door fluid channel 420, thereby cooling a user interface unit 200 mounted to an exterior door panel 114 and thermally connected to the door fluid channel 420. The rising heated air can additionally drive fluid flow through a connected fluid channel (e.g., top fluid channel). Alternatively, the configuration of the fluid channels 410 can facilitate fluid movement therethrough. For example, the top fluid channel 430 can expand from the first end (proximal the door) to the second end (proximal the back), which can function to drive fluid flow from the first to the second end. However, the thermal management system 400 can otherwise facilitate passive fluid flow.

In a second embodiment of the second variation, fluid can be actively moved through a fluid channel 410 (e.g., via forced convection) and/or a cooking cavity 105. The fluid is preferably driven by a convection element 480 fluidly connected to the fluid channel 410 and/or cooking cavity 105 along at least one convection element end, but can alternatively be driven by a pressurized fluid source or be driven by any other suitable fluid movement mechanism. The connected oven 100 can include any number of convection elements 480. A set of convection elements 480 can include fans, sensors 310, indicators (e.g., lights), vents, or include any other suitable component.

The convection element(s) 480 (e.g., the cooking convection element 482, cooling convection element 484) can define a first end and a second end, wherein the first and/or second ends can define the convection element inlet and/or outlet. The first and second ends are preferably fluidly connected to each other through the convection element body, but can alternatively be otherwise related. However, the convection element 480 can be otherwise configured. In one variation, an end of the convection element 480 can be fluidly connected to the ambient environment through fluid-permeable openings in the oven back 130 (e.g., the exterior panel). In a second variation, an end of the convection element 480 can be fluidly connected to the cavity through fluid-permeable openings in the oven back 130 (e.g., the interior panel). In a third variation, an end of the convection element 480 can be fluidly connected to the back channel (e.g., defined by the interior and exterior panel of the oven back). However, the convection element 480 can be fluidly and/or thermally connected to any other suitable space.

The thermal management system 400 can include any number of convection elements 480. The convection elements 480 are preferably individually indexed and controlled (e.g., by a processing system 320 of the connected oven 100), but can alternatively be indexed or controlled in aggregate. Individual convection elements 480 of a set of convection elements 480 can rotate in a same direction (e.g., a first and a second cooking convection element rotating clockwise), opposite directions (e.g., a first cooking convection element 482' rotating clockwise, and a second cooking convection element 482" rotating counter-clockwise), and/or any suitable direction.

In a first example of the second embodiment, the convection element 480 can be a cooking convection element 482, used to move fluid through the cooking cavity 105. The cooking convection element 482 can additionally be fluidly connected to the oven exterior, and can function to fluidly connect the cooking cavity 105 to the ambient environment. In one variation of the cooking convection element 482, the element includes a fan (e.g., a cone fan with the apex proximal the cooking cavity 105), wherein the fan can be fluidly connected to the cooking cavity 105 at one end and directly or indirectly fluidly connected to the ambient environment (e.g., through a fluid channel 410). The cooking convection element 482 can be mounted to the oven back (e.g., the external panel and/or the internal panel), or mounted to any other suitable component.

The cooking convection element 482 can be a separate convection element 480 from that used to move fluid within the cooking cavity 105, but can alternatively be the same convection element 480 as that used to move fluid within the cooking cavity 105. When the cooling convection element 484 is a separate convection element 480, the convection element 480 can be directly fluidly connected to the fluid channel 410 (or set of fluidly connected fluid channels 410), arranged in series within the fluid channel, or otherwise connected to the fluid channel. In one example, a convection element 480 can force air from the fluid source into the fluid channels 410. In a second example, the convection element 480 can force air out of the fluid channels 410. However, the convection element 480 can otherwise control fluid flow therein.

In one variation of the cooking convection element 482, the convection element 480 sucks air from the ambient environment, in through the distal end of the fluid channel 410, and into the cooking cavity 105. The cooling fluid can entrain waste heat from the heat-sensitive or heat-generating components within the fluid channel 410, which can additionally function to pre-heat the air introduced into the cooking cavity 105. This can function to decrease the thermal variation within the cooking cavity 105 due to cool air introduction and/or minimize the amount of energy required to heat the newly introduced air. In a second variation of the cooking convection element 482, the fan can suck air from the cooking cavity 105, through the fluid channel 410, and out the fluid channel end.

Alternatively, the fluid channel 410 can be fluidly connected to the cooking cavity 105, wherein the convection element 480 is directly fluidly connected to the ambient environment and the cooking cavity 105. In this variation, the convection element 480 can blow air from the ambient environment into the cooking cavity 105, wherein the positive pressure from the cooking cavity 105 (due to the convection element 480 blowing air into the cooking cavity 105 from the ambient environment) forces air from the cooking cavity 105 into the fluid channel 410. Alternatively, the convection element 480 can suck air from the cooking cavity 105 out into the ambient environment, wherein the negative pressure caused by the convection element 480 sucks air through the fluid channel 410 and into the cooking cavity 105.

In a second example of the second embodiment, the convection element 480 can be a fluid channel convection element (cooling convection element 484), used to move fluid through a fluid channel 410 (e.g., a top fluid channel 430, a door fluid channel 420, etc.). In specific examples, the thermal management system 400 can include a cooking convection element 482 and a fluid channel convection element. As shown in FIG. 20, in one specific example, a cooling convection element 484 can be mounted to the oven back 130 at a region proximal the oven top 120, where the cooling convection element 484 can be fluidly connected to the top fluid channel 430, and the cooling convection element 484 can be configured to draw cooling fluid from an ambient environment into the top fluid channel 430 through a top fluid channel inlet 432. Additionally or alternatively, the cooling convection element 484 can be connected to the top fluid channel outlet 434. In this specific example, a cooking convection element 482 (e.g., distinct from the cooling convection element 484) can be mounted to the oven back 130 and fluidly connected to the cooking cavity 105. In this specific example, the oven back 130 can be dual-panel, where the interior back panel 132 can include perforations fluidly connecting a back fluid channel 440 to the cooking cavity 105, and where the cooking convection element 482 is configured to draw fluid into the back fluid channel 440 from the cooking cavity 105. The back fluid channel 440 is preferably fluidly isolated from the top fluid channel 430, but can be fluidly connected or have any suitable relationship.

However, convection elements 480 can be otherwise configured.

1.5 Heating Elements

As shown in FIGS. 3, 19, and 24-26, the oven can additionally include a set of heating elements 500 (e.g., arranged along the sides, top, or bottom of the cooking cavity 105, etc. However, heating elements 500 of the connected oven 100 can otherwise be configured, where heating elements 500 can additionally or alternatively be configured in any manner analogous to those disclosed in related U.S. application Ser. No. 15/147,597.

1.6 Heat Dissipation Elements

Figure 32:
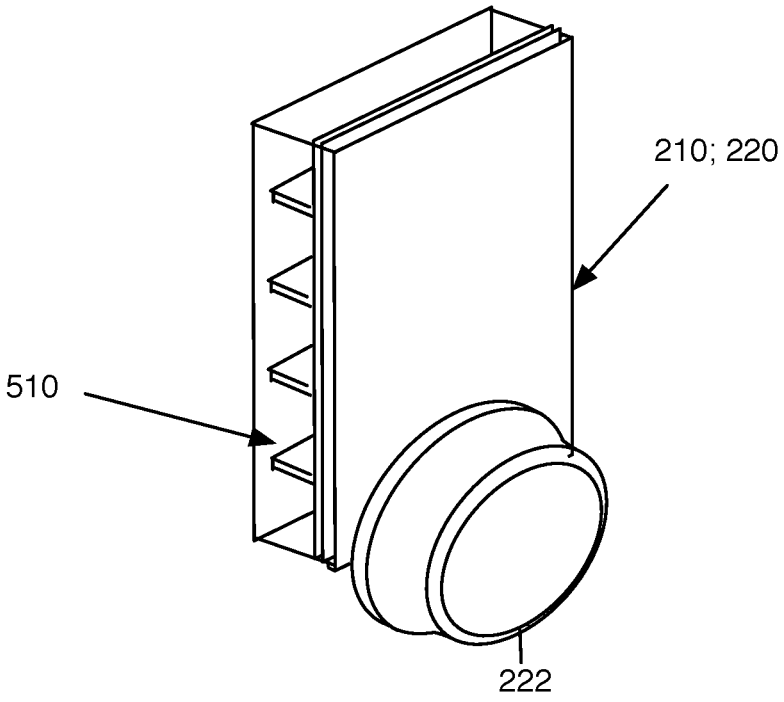
FIG. 32 is a schematic representation of an example of a heat dissipation element.
Figure 33:
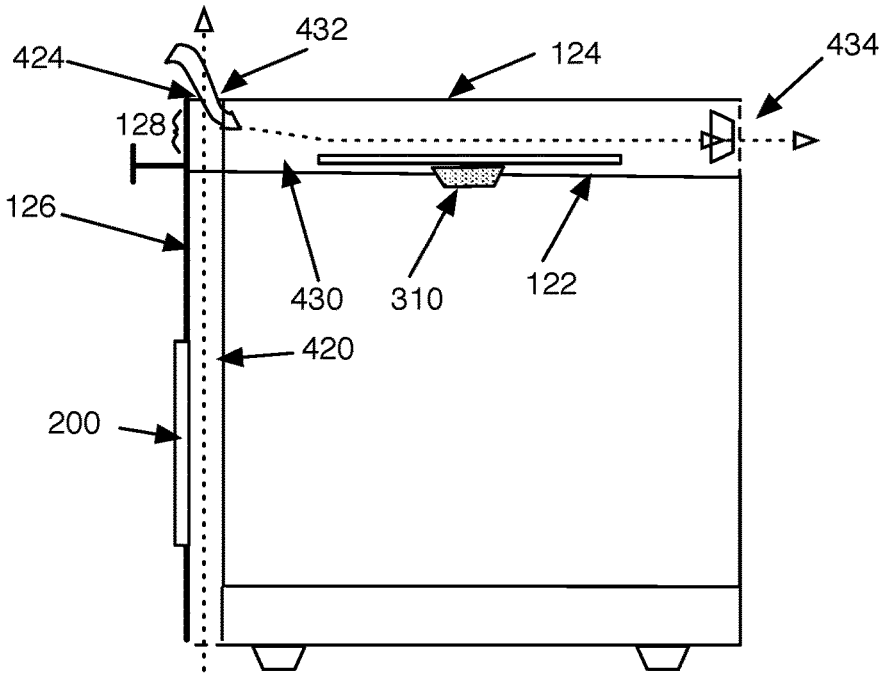
FIG. 33 is a schematic representation of a side view a variation of the oven.

As shown in FIG. 32, the connected oven 100 can additionally or alternatively include one or more heat dissipation elements 510, which function to dissipate heat associated with components of the oven 100. Heat dissipation elements 510 preferably dissipate heat generated by an active oven component (e.g., processing system, camera system, etc.), but can additionally or alternatively dissipate any heat associated with the oven 100. The connected oven 100 can include one or more heat dissipation elements 510: per system, per heat-generating component (e.g., processor 320, camera unit 300, user interface unit 200, etc.), and/or per any suitable component of the connected oven 100. Additionally or alternatively, a single heat dissipation element 510 can dissipate heat for multiple components (e.g., a processor 320 and a user interface unit 200) of the connected oven 100. However one or more heat dissipation elements 510 can have any suitable relationship with any suitable component of the connected oven 100. The heat dissipation elements 510 can be arranged with the heat dissipation features arranged within the cooling fluid channel, perpendicular the cooling fluid flow vector, or at any other suitable angle relative to the cooling fluid channel. The heat dissipation features can be thermally connected, fluidly connected, thermally isolated, fluidly isolated, or otherwise related to the cooling fluid flow.

A heat dissipation element 510 can be configured to thermally contact a surface of the connected oven 100 and/or active component. In examples, a heat sink 510 can be thermally connected to component surface directly, with thermal paste, and/or with using any suitable thermal interface. Attachment mechanisms for heat dissipation elements 510 to surfaces of the connected oven 100 can include plates (e.g., conductive thick plates between a heat source and a heat sink), clips (e.g., for direct attachment of a heat sink to a component), and/or any other suitable mechanism. Heat dissipation elements 510 and/or associated attachment mechanisms can include one or more materials such as metal, include metals (e.g., aluminum alloys, copper, etc.), diamond, composite materials, plastics, and/or any suitable material. However, a heat dissipation element 510 can be otherwise configured.

Heat dissipation elements 510 can include heat sinks and/or any other suitable type of heat dissipation element 510. Heat dissipation elements 510 can extend from any suitable thermal contact surface of the connected oven 100. For example, a heat dissipation element 510 can extend from the surface opposing a component-coupling interface (e.g., a mounting region 116 for a user interface unit 200), a distal component, and/or any suitable oven component. A heat dissipation element 510 can include fins, pins, cavities and/or any suitable heat dissipation features. Fins can be straight, curved, sinusoidal, and/or possess any suitable orientation. Pins can be cylindrical, prismatic, polygonal, and/or have any suitable shape. Heat dissipation features of a set of heat dissipation features can be arranged adjacent one another (e.g., with distance between adjacent fins), parallel, perpendicular, distal, proximal, touching, non-touching, with increasing and/or decreasing separation as distance along an axis increases, form columns, rows, and/or have any suitable orientation. However, heat dissipation elements 510 can be otherwise oriented.

1.7 Examples

In a first variation of the oven, the display 210 and input device(s) 220 are mounted to an exterior panel of a dual panel oven door 110, wherein the dual-panel oven door 110 cooperatively defines a door fluid channel 420 therebetween. The door fluid channel 420 can be open along a top and bottom end, and/or be open along the lateral sides. In this first variation, the display 210 and input device(s) 220 can be cooled and/or thermally insulated by air passively driven upwards through the fluid channel 420 by heat leaked from the oven. In this first variation, the bottom wall can define an air gap aligned with the bottom door fluid channel end, wherein ambient air flows through the bottom wall into the door fluid channel 420. Alternatively, the bottom wall can terminate before the fluid channel 420, such that the fluid channel 420 is substantially unobstructed when the door is closed, thereby facilitating ambient fluid to enter the door fluid channel 420 through a door fluid channel inlet 422 defined by the oven door 110. In one example, the fluid channel 420 can include an active convection element 480 arranged in series with the door fluid channel 420 that drives fluid flow therethrough. In another example, the fluid channel 420 can be fluidly connected to a second fluid channel defined by an adjacent wall (e.g., sidewalls 140, bottom, top, etc.), wherein fluid flow through the second fluid channel can be toward the door fluid channel 420 (secondary fluid flow), and can terminate at the exterior door panel 114. The secondary fluid flow can terminate proximal an end of the door, wherein the fluid flow can be driven toward the opposing door end, or terminate proximal the door center, wherein the fluid flow can split and be driven toward opposing door ends.

In this first variation, a control system 300 (e.g., camera assembly) can be mounted to the interior panel of a dual panel top, wherein the dual panel top cooperatively defines a top fluid channel 430 therebetween. The control system 300 can be directly mounted to the interior panel, or be mounted to cooling features 490 extending into the cooling channel from the interior panel. In this variation, the top fluid channel 430 is fluidly isolated from the door fluid channel 420. Further, both the top fluid channel 430 and the door fluid channel 420 are fluidly isolated from a back fluid channel 440 in this variation.

In a first variation, the top cooling channel 430 can be open along the front and back, wherein fluid flows from the front to the back or from the back to the front. The cooling features 490 and/or dual panels can be configured to facilitate active flow in the desired cooling direction (e.g., through using a fluid channel convection element 484 fluidly connected to the top channel 430 and drawing ambient fluid from a top fluid channel inlet 432 proximal the oven door 110 to a top fluid channel outlet 434 proximal the oven back 130, but can alternatively be configured to be direction agnostic. Alternatively, fluid from the door channel 420 can be redirected into and/or drive fluid flow through the top channel 430. Alternatively, a passive convection element 480 can move air through the top channel 430. In a specific example, the convection element 482 of the cooking cavity 105 can pull air in through the front opening (e.g., from ambient or the fluid channel 410), through the top channel 430, through a back channel 440 defined in the back panel 130, and into the cooking cavity 105. In a second specific example, a convection element 480 can blow air through the top channel 430 to the exterior door panel 114, through the door channel 420, and out the fluid outlets in the door channel 420. However, this variation can direct fluid along any other suitable path.

In one specific example of fluid flow in the first variation, the thermal management system 400 can facilitate: passively moving first ambient fluid from a door fluid channel inlet 422 proximal the oven bottom 150 to a door fluid channel outlet 424 proximal the oven top 120, thereby thermally cooling a user interface unit 200 mounted to an exterior door panel 114 mounting region 116 thermally connected to the door fluid channel 420; actively moving, using a first convection element 484 fluidly connected to a top fluid channel 430, second ambient fluid from a top fluid channel inlet 432 defined by an exterior top panel 124 to a top fluid channel outlet 434 proximal the oven back iso; and actively recycling, using a second convection element 482, cooking cavity fluid through the convection element 482 into a back fluid channel 440; and re-directing the cooking cavity fluid from the back fluid channel 440 into the cooking cavity 105, wherein the door fluid channel 420, the top fluid channel 430, and the back fluid channel 440 are each fluidly isolated from one another. However, fluid flow in the first variation can be otherwise configured.

Figure 18:
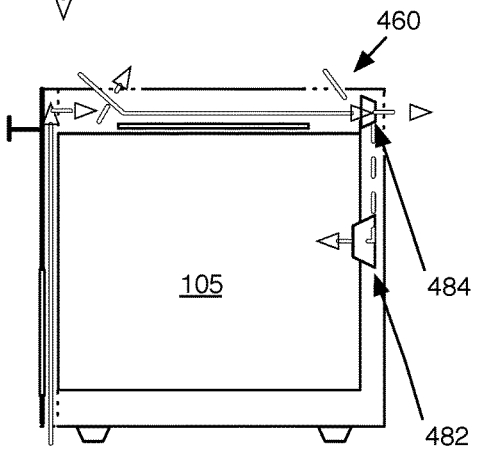

As shown in FIG. 18, in a second variation of the oven, a door fluid channel 420, top fluid channel 430, and back fluid channel 440 are fluidly connected. In this variation, outlets of a fluid channel 410 can be fluidly connected to inlets of a separate fluid channel 410, but fluid connections between fluid channels 410 can be otherwise configured. In one specific example of fluid flow in the second variation, the thermal management system 400 can facilitate: passively moving fluid from an ambient environment into the door fluid channel 420 through a door fluid channel inlet 422 proximal the oven bottom 150; re-directing the fluid from the door fluid channel 420 to a top fluid channel 430 at an open junction cooperatively defined by the oven door 110 and the oven top 120; drawing the fluid towards the oven back 130 using a first convection element 480; redirecting the fluid from the top fluid channel 430 to the back fluid channel 440 at an open junction cooperatively defined by the oven top 120 and the oven back 130; and drawing the fluid from the oven back 130 into the cooking cavity 105 using a second convection element 482 mounted at the oven back 130. However, fluid flow in the second variation can be otherwise configured.

In a third variation of the oven, the cooling channel can be sealed along the front, include fluid apertures along the exterior panel (e.g., along the panel perimeter or body), and include a fluid apertures along the back. In this variation, the convection element 482 of the cooking cavity 105 can pull air in through the fluid inlets, through the top channel 430, through a back channel defined in the back panel, and into the cooking cavity 105. Alternatively, the convection element 480 can pull air in from ambient through the fluid inlet in the back panel, blow the air through the top channel 430, and blow the air out through the fluid outlets in the exterior top panel 124. However, the top channel 430 can receive fluid from any other suitable fluid channel 410, or be otherwise configured.

In a fourth variation of the oven, of the oven, as shown in FIG. 23, the oven includes a touchscreen including a display 210 and input device 220 arranged in the oven door 110, a control system 300 collocated with the touchscreen (e.g., configured as a singular unit with the touchscreen), and a set of sensors 310 and emitters arranged along the oven top 120.

Although omitted for conciseness, the preferred embodiments include every combination and permutation of the various system components and the various method processes.

As a person skilled in the art will recognize from the previous detailed description and from the figures and claims, modifications and changes can be made to the preferred embodiments of the invention without departing from the scope of this invention defined in the following claims.

We claim:

1. A connected oven, comprising:

a heating element;

an oven body comprising:

an oven back;

an oven bottom;

an oven top opposing the oven bottom, the oven top comprising an interior top panel and an exterior top panel cooperatively defining a top fluid channel therebetween, wherein the interior top panel, the oven back, and the oven bottom cooperatively define a cooking cavity;

an oven door mounted to the oven body, the oven door comprising an interior door panel and an exterior door panel cooperatively defining a door fluid channel therebetween, the interior door panel cooperatively defining the cooking cavity with the oven body, wherein the exterior door panel defines a user interface mounting region thermally connected to the door fluid channel;

wherein the oven door is nested under an overhang defined by the oven top, wherein the interior top panel defines:

an interior perforated portion coextensive with the overhang and comprising a first plurality of perforations aligned with and fluidly connected to the door fluid channel along a vertical axis through the door fluid channel, and a solid portion coextensive with the overhang and fluidly isolating the door fluid channel from the top fluid channel; and wherein the exterior top panel defines:

a first exterior perforated portion coextensive with the overhang and comprising a second plurality of perforations aligned with the door fluid channel and the solid portion of the interior top panel along the vertical axis, wherein the second plurality of perforations defines a top fluid channel inlet;

a user interface unit mounted to the user interface mounting region, the user interface unit comprising a touchscreen input device; and a camera assembly defining a field of view directed toward the oven bottom, the camera assembly mounted to the oven top and thermally connected to the top fluid channel.

2. The connected oven of claim 1, wherein the oven door is actuatable between an open position and a closed position relative the oven body, and wherein a broad face of the user interface unit is arranged with a normal vector intersecting the cooking cavity when the oven door is in the closed position.

3. The connected oven of claim 2, further comprising a processing system connected to the user interface unit and the camera assembly, the processing system mounted to the user interface unit, and the processing system thermally connected to the door fluid channel.

4. The connected oven of claim 1, wherein the camera assembly is mounted to the interior top panel and extends from the top fluid channel into the cooking cavity, wherein the camera assembly comprises:

a printed circuit board (PCB) mounted to a top face of the interior top panel, the top face facing the top fluid channel; and a camera electrically coupled to the PCB and extending into the cooking cavity.

5. The connected oven of claim 4, wherein a broad face of the interior top panel comprises a cooling fin extending from the broad face of the interior top panel, and wherein the PCB is mounted to the cooling fin.

6. The connected oven of claim 1, wherein the door fluid channel comprises:

a door fluid channel inlet proximal the oven bottom, and a door fluid channel outlet fluidly connected to an ambient environment through the first plurality of perforations of the interior perforated portion of the interior top panel, the door fluid channel outlet proximal the oven top;

wherein the top fluid channel comprises:

the top fluid channel inlet fluidly connected to the ambient environment through the second plurality of perforations of the first exterior perforated portion of the exterior top panel, and a top fluid channel outlet arranged proximal the oven back, wherein the camera assembly is arranged within the top fluid channel between the top fluid channel inlet and the top fluid channel outlet.

7. The connected oven of claim 6, wherein a plane of the door fluid channel inlet is perpendicular a door flow axis defined by the door fluid channel, and wherein a plane of the top fluid channel inlet is parallel a top flow axis defined by the top fluid channel.

8. The connected oven of claim 6, wherein the solid portion of the interior top panel and the first exterior perforated portion of the exterior top panel are structurally connected by a front wall fluidly isolating the door fluid channel from the top fluid channel.

9. The connected oven of claim 7 wherein the oven back defines the top fluid channel outlet.

10. The connected oven of claim 9, further comprising a convection element mounted to the oven back, the convection element fluidly connected to the top fluid channel, and the convection element configured to draw cooling fluid from the ambient environment into the top fluid channel through the top fluid channel inlet.

11. The connected oven of claim 9, wherein the oven back comprises a wall offset extending away from the cooking cavity.

12. The connected oven of claim 6, wherein the oven bottom defines a front edge nested under the oven door when the oven door is in the closed position, and wherein the front edge defines an external fluid connection aligned with the door fluid channel inlet.

13. The connected oven of claim 1, wherein the exterior top panel defines a second exterior perforated portion coextensive with the overhang and the interior perforated portion of the interior top panel, wherein the second exterior perforated portion and the interior perforated portion cooperatively define an overhang fluid channel therebetween, the overhang fluid channel fluidly connecting the door fluid channel to the ambient environment.

14. A connected oven, comprising:

a heating element;

an oven back;

an oven bottom;

an oven top opposing the oven bottom, the oven top comprising:

an interior top panel and an exterior top panel cooperatively defining a top fluid channel therebetween, the top fluid channel comprising a top fluid channel inlet and a top fluid channel outlet, wherein a flow axis of the top fluid channel is substantially parallel a normal vector of the oven back, and wherein the interior top panel, the oven back, and the oven bottom cooperatively define a cooking cavity;

an oven door nested under an overhang defined by the oven top, wherein the interior top panel defines:

an interior perforated portion coextensive with the overhang and comprising a first plurality of perforations aligned with and fluidly connected to a door fluid channel along a vertical axis through the door fluid channel, and a solid portion coextensive with the overhang and fluidly isolating the door fluid channel from the top fluid channel; and wherein the exterior top panel defines:

a first exterior perforated portion coextensive with the overhang and comprising a second plurality of perforations aligned with the door fluid channel and the solid portion of the interior top panel along the vertical axis, wherein the second plurality of perforations defines a top fluid channel inlet; and an optical sensor defining a field of view directed toward the oven bottom, the optical sensor arranged within and thermally connected to the top fluid channel between the top fluid channel inlet and the top fluid channel outlet.

15. The connected oven of claim 14, wherein the optical sensor is mounted to the interior top panel.

16. The connected oven of claim 14, further comprising a first convection element mounted to the oven back, the first convection element fluidly connected to the top fluid channel, and the first convection element configured to draw cooling fluid from an ambient environment into the top fluid channel through the top fluid channel inlet.

17. The connected oven of claim 16, wherein the oven back comprises an exterior back panel and an interior back panel cooperatively defining a back fluid channel therebetween, the interior back panel defining the cooking cavity.

18. The connected oven of claim 17, further comprising a second convection element mounted to the oven back, the second convection element fluidly connected to the cooking cavity, wherein the interior back panel comprises perforations fluidly connecting the back fluid channel to the cooking cavity, and wherein the second convection element is configured to draw fluid into the back fluid channel from the cooking cavity.

19. The connected oven of claim 18, wherein the back fluid channel and the top fluid channel are fluidly isolated by an intervening wall.

20. A connected oven, comprising:

a heating element;

an oven body defining a cooking cavity, the oven body comprising an oven base;

an oven top comprising an interior top panel and an exterior top panel cooperatively defining a top fluid channel therebetween;

an oven door mounted to the oven body, the oven door actuatable between an open position and a closed position relative the oven body, and the oven door comprising:

an interior door panel and an exterior door panel cooperatively defining a door fluid channel therebetween, the door fluid channel defining a flow axis substantially parallel a normal vector of the oven base when the oven door is in the closed position, wherein the interior and the exterior door panel each comprise a transparent window coextensive with the cooking cavity, and wherein the transparent windows have substantially similar visual transmittance;

wherein the interior top panel defines:

an interior perforated portion coextensive with an overhang and comprising a first plurality of perforations aligned with and fluidly connected to the door fluid channel along a vertical axis through the door fluid channel, and a solid portion coextensive with the overhang and fluidly isolating the door fluid channel from the top fluid channel; and wherein the exterior top panel defines:

a first exterior perforated portion coextensive with the overhang and comprising a second plurality of perforations aligned with the door fluid channel and the solid portion of the interior top panel along the vertical axis, wherein the second plurality of perforations defines a top fluid channel inlet; and a user interface unit mounted to the transparent window of the exterior door panel, the user interface unit thermally connected to the door fluid channel, the user interface unit comprising:

a touchscreen input device overlaying a display; and a broad face arranged with a normal vector intersecting the cooking cavity when the oven door is in the closed position.

21. The connected oven of claim 20, wherein the exterior door panel further comprises a metal bezel extending about edges of the exterior door panel, the metal bezel cooperatively defining an inlet of the door fluid channel and an outlet of the door fluid channel.

22. The connected oven of claim 21, wherein the user interface unit is mounted to a mounting region of the transparent window of the exterior door panel, the mounting region offset from an edge of the exterior door panel, wherein a transparent region of the transparent window is arranged between the mounting region and the edge of the exterior door panel.

23. The connected oven of claim 22, wherein the transparent window of the exterior door panel comprises glass, and wherein the transparent region of the transparent window thermally insulates the user interface unit from the metal bezel.

24. The connected oven of claim 20, wherein the user interface unit further comprises a metal rotary knob, the rotary knob actuatable about a rotary axis and arranged with the rotary axis intersecting the cooking cavity.

* * * * *